US009051093B2

(12) United States Patent
Yang et al.

(10) Patent No.: US 9,051,093 B2
(45) Date of Patent: Jun. 9, 2015

(54) RECEPTACLE WITH MOTION DAMPER NEAR LID

(71) Applicant: simplehuman, LLC, Torrance, CA (US)

(72) Inventors: Frank Yang, Rancho Palos Verdes, CA (US); Di-Fong Chang, Torrance, CA (US); Joseph Sandor, Santa Ana Heights, CA (US)

(73) Assignee: simplehuman, LLC, Torrance, CA (US)

( * ) Notice: Subject to any disclaimer, the term of this patent is extended or adjusted under 35 U.S.C. 154(b) by 0 days.

(21) Appl. No.: 13/783,149

(22) Filed: Mar. 1, 2013

(65) Prior Publication Data

US 2014/0246432 A1 Sep. 4, 2014

(51) Int. Cl.

| | |
|---|---|
| ***B65D 43/26*** | (2006.01) |
| ***B65F 1/16*** | (2006.01) |
| ***B65F 1/14*** | (2006.01) |

(52) U.S. Cl.

CPC ..... *B65D 43/262* (2013.01); *Y10T 29/49826* (2015.01); *B65F 1/163* (2013.01); *B65F 2001/1661* (2013.01)

(58) Field of Classification Search

CPC ..... B65F 1/163; B65F 1/1623; B65F 2001/1661; B65F 1/06; B65D 43/262; B65D 43/26

USPC ..... 220/264, 263, 262, 260, 495.11, 220/495.08, 495.06, 908.1, 908, 827, 810; D34/9, 8, 7, 1

IPC ... B65F 1/163, 1/1623, 2001/1661, 1/06; B65D 43/262, 43/26

See application file for complete search history.

(56) References Cited

U.S. PATENT DOCUMENTS

| | | | | |
|---|---|---|---|---|
| 1,426,211 | A | 8/1922 | Pausin | |
| 1,461,253 | A | 7/1923 | Owen | |
| 1,754,802 | A | 4/1930 | Raster | |
| 1,820,555 | A | 8/1931 | Buschman | |
| 1,891,651 | A | 12/1932 | Padelford et al. | |
| 1,922,729 | A | 8/1933 | Giebel | |
| 1,980,938 | A | 11/1934 | Geibel | |
| 2,308,326 | A * | 1/1943 | Ambrose | 220/263 |

(Continued)

FOREIGN PATENT DOCUMENTS

| | | |
|---|---|---|
| AU | 622536 | 4/1992 |
| CA | 2519295 | 3/2007 |

(Continued)

OTHER PUBLICATIONS

Translation of DE 822376 (Guenther), Oct. 11, 1951, pp. 3-4.*

(Continued)

*Primary Examiner* — Robert J Hicks

(74) *Attorney, Agent, or Firm* — Knobbe, Martens, Olson & Bear, LLP

(57) ABSTRACT

A receptacle assembly including a body portion, a lid portion, a pedal portion, a rod, and a motion damper. The body portion includes an upper portion and a base portion and defines an interior space. The lid portion is movably engaged with the body portion and is configured to move between an open position and a closed position. The pedal portion is configured to move the lid portion between the open position and the closed position. A rod extends between the lid portion and the pedal portion. The rod can also interface with the motion damper. The motion damper is positioned near the lid portion and is configured to dampen motion of the rod.

27 Claims, 17 Drawing Sheets

(56) References Cited

U.S. PATENT DOCUMENTS

| | | | |
|---|---|---|---|
| D148,825 | S | 2/1948 | Snider |
| 2,457,274 | A | 12/1948 | Rifken |
| 2,759,625 | A | 8/1956 | Ritter |
| 2,888,307 | A | 5/1959 | Graves et al. |
| 2,946,474 | A | 7/1960 | Knapp |
| 3,008,604 | A | 11/1961 | Garner |
| 3,023,922 | A | 3/1962 | Arrington et al. |
| 3,137,408 | A | 6/1964 | Taylor |
| 3,654,534 | A | 4/1972 | Fischer |
| 3,820,200 | A | 6/1974 | Myers |
| 3,825,150 | A | 7/1974 | Taylor |
| 3,825,215 | A | 7/1974 | Borglum |
| 3,886,425 | A | 5/1975 | Weiss |
| 3,888,406 | A | 6/1975 | Nippes |
| 3,891,115 | A | 6/1975 | Ono |
| 4,014,457 | A | 3/1977 | Hodge |
| 4,027,774 | A | 6/1977 | Cote |
| 4,081,105 | A | 3/1978 | Dagonnet et al. |
| 4,189,808 | A | 2/1980 | Brown |
| 4,200,197 | A | 4/1980 | Meyer et al. |
| 4,217,616 | A | 8/1980 | Jessup |
| 4,303,174 | A | 12/1981 | Anderson |
| 4,320,851 | A | 3/1982 | Montoya |
| 4,357,740 | A | 11/1982 | Brown |
| 4,416,197 | A | 11/1983 | Kehl |
| 4,457,483 | A | 7/1984 | Gagne |
| 4,535,911 | A | 8/1985 | Goulter |
| 4,570,304 | A | 2/1986 | Montreuil et al. |
| 4,576,310 | A | 3/1986 | Isgar et al. |
| D284,320 | S | 6/1986 | Kubic et al. |
| 4,609,117 | A | 9/1986 | Pamment |
| 4,630,332 | A | 12/1986 | Bisbing |
| 4,630,752 | A | 12/1986 | DeMars |
| 4,664,347 | A | 5/1987 | Brown et al. |
| 4,697,312 | A | 10/1987 | Freyer |
| 4,711,161 | A | 12/1987 | Swin et al. |
| 4,729,490 | A | 3/1988 | Ziegenbein |
| 4,753,367 | A | 6/1988 | Miller et al. |
| 4,763,808 | A | 8/1988 | Guhl et al. |
| 4,765,548 | A | 8/1988 | Sing |
| 4,765,579 | A | 8/1988 | Robbins et al. |
| 4,785,964 | A | 11/1988 | Miller et al. |
| 4,792,039 | A | 12/1988 | Dayton |
| 4,794,973 | A | 1/1989 | Perisic |
| 4,834,260 | A | 5/1989 | Auten |
| 4,863,053 | A | 9/1989 | Oberg |
| 4,867,339 | A | 9/1989 | Hahn |
| 4,884,717 | A | 12/1989 | Bussard et al. |
| 4,892,223 | A | 1/1990 | DeMent |
| 4,892,224 | A | 1/1990 | Graham |
| 4,913,308 | A | 4/1990 | Culbertson |
| 4,915,347 | A | 4/1990 | Iqbal et al. |
| 4,918,568 | A | 4/1990 | Stone et al. |
| D308,272 | S | 5/1990 | Koepsell |
| 4,923,087 | A | 5/1990 | Burrows |
| 4,948,004 | A | 8/1990 | Chich |
| 4,964,523 | A | 10/1990 | Bieltvedt et al. |
| 4,972,966 | A | 11/1990 | Craft, Jr. |
| 4,996,467 | A | 2/1991 | Day |
| 5,031,793 | A | 7/1991 | Chen et al. |
| 5,048,903 | A | 9/1991 | Loblein |
| 5,054,724 | A | 10/1991 | Hutcheson |
| 5,065,272 | A | 11/1991 | Owen et al. |
| 5,065,891 | A | 11/1991 | Casey |
| 5,076,462 | A | 12/1991 | Perrone |
| D323,573 | S | 1/1992 | Schneider |
| 5,090,785 | A | 2/1992 | Stamp |
| 5,100,087 | A | 3/1992 | Ashby |
| 5,111,958 | A | 5/1992 | Witthoeft |
| D327,760 | S | 7/1992 | Donnelly |
| D329,929 | S | 9/1992 | Knoedler et al. |
| 5,147,055 | A | 9/1992 | Samson et al. |
| 5,156,290 | A | 10/1992 | Rodrigues |
| 5,170,904 | A | 12/1992 | Neuhaus |
| 5,174,462 | A | 12/1992 | Hames |
| D335,562 | S | 5/1993 | Evans |
| 5,213,272 | A | 5/1993 | Gallagher et al. |
| 5,222,704 | A | 6/1993 | Light |
| D337,181 | S | 7/1993 | Warman |
| 5,226,558 | A | 7/1993 | Whitney et al. |
| 5,230,525 | A | 7/1993 | Delmerico et al. |
| 5,242,074 | A | 9/1993 | Conaway et al. |
| D340,333 | S | 10/1993 | Duran et al. |
| 5,249,693 | A | 10/1993 | Gillispie et al. |
| 5,261,553 | A | 11/1993 | Mueller et al. |
| 5,265,511 | A | 11/1993 | Itzov |
| 5,305,916 | A | 4/1994 | Suzuki et al. |
| 5,314,151 | A | 5/1994 | Carter-Mann |
| 5,322,179 | A | 6/1994 | Ting |
| 5,329,212 | A | 7/1994 | Feigleson |
| 5,348,222 | A | 9/1994 | Patey |
| 5,381,588 | A | 1/1995 | Nelson |
| 5,385,258 | A | 1/1995 | Sutherlin |
| 5,390,818 | A | 2/1995 | LaBuda |
| 5,404,621 | A | 4/1995 | Heinke |
| 5,407,089 | A | 4/1995 | Bird et al. |
| 5,419,452 | A | 5/1995 | Mueller et al. |
| 5,471,708 | A | 12/1995 | Lynch |
| 5,474,201 | A | 12/1995 | Liu |
| 5,501,358 | A | 3/1996 | Hobday |
| 5,520,067 | A | 5/1996 | Gabas |
| 5,520,303 | A | 5/1996 | Bernstein et al. |
| 5,531,348 | A | 7/1996 | Baker et al. |
| 5,535,913 | A | 7/1996 | Asbach et al. |
| 5,558,254 | A | 9/1996 | Anderson et al. |
| 5,584,412 | A | 12/1996 | Wang |
| D377,554 | S | 1/1997 | Adriaansen |
| 5,611,507 | A | 3/1997 | Smith |
| 5,628,424 | A | 5/1997 | Gola |
| 5,632,401 | A | 5/1997 | Hurd |
| 5,636,416 | A | 6/1997 | Anderson |
| 5,644,111 | A | 7/1997 | Cerny et al. |
| 5,645,186 | A | 7/1997 | Powers et al. |
| 5,650,680 | A | 7/1997 | Chula |
| D383,277 | S | 9/1997 | Peters |
| 5,662,235 | A | 9/1997 | Nieto |
| 5,690,247 | A | 11/1997 | Boover |
| 5,695,088 | A | 12/1997 | Kasbohm |
| 5,699,929 | A | 12/1997 | Ouno |
| D388,922 | S | 1/1998 | Peters |
| D389,631 | S | 1/1998 | Peters |
| 5,704,511 | A | 1/1998 | Kellams |
| 5,724,837 | A | 3/1998 | Shin |
| 5,730,312 | A | 3/1998 | Hung |
| 5,732,845 | A | 3/1998 | Armaly, Jr. |
| 5,735,495 | A | 4/1998 | Kubota |
| 5,738,239 | A | 4/1998 | Triglia |
| 5,799,909 | A | 9/1998 | Ziegler |
| 5,816,431 | A | 10/1998 | Giannopoulos |
| 5,816,640 | A | 10/1998 | Nishimura |
| D401,383 | S | 11/1998 | Gish |
| D401,719 | S | 11/1998 | Van Leeuwen et al. |
| 5,873,643 | A | 2/1999 | Burgess, Jr. et al. |
| 5,881,896 | A | 3/1999 | Presnell et al. |
| 5,881,901 | A | 3/1999 | Hampton |
| 5,884,237 | A | 3/1999 | Kanki et al. |
| 5,887,748 | A | 3/1999 | Nguyen |
| 5,961,105 | A | 10/1999 | Ehrnsberger et al. |
| 5,967,392 | A | 10/1999 | Niemi et al. |
| 5,987,708 | A | 11/1999 | Newton |
| 6,000,569 | A | 12/1999 | Liu |
| 6,010,024 | A | 1/2000 | Wang |
| 6,024,238 | A | 2/2000 | Jaros |
| 6,036,050 | A | 3/2000 | Ruane |
| 6,102,239 | A | 8/2000 | Wien |
| 6,123,215 | A | 9/2000 | Windle |
| D431,700 | S | 10/2000 | Roudebush |
| 6,126,031 | A | 10/2000 | Reason |
| 6,129,233 | A | 10/2000 | Schiller |
| D435,951 | S | 1/2001 | Yang et al. |
| 6,209,744 | B1 | 4/2001 | Gill |
| 6,211,637 | B1 | 4/2001 | Studer |
| 6,234,339 | B1 | 5/2001 | Thomasd |
| 6,250,492 | B1 | 6/2001 | Verbeek |

(56) References Cited

U.S. PATENT DOCUMENTS

| | | | |
|---|---|---|---|
| D445,980 | S | 7/2001 | Tjugum |
| 6,286,706 | B1 | 9/2001 | Tucker |
| 6,328,320 | B1 | 12/2001 | Walski et al. |
| 6,345,725 | B1 | 2/2002 | Lin |
| 6,364,147 | B1 | 4/2002 | Meinzinger et al. |
| 6,386,386 | B1 | 5/2002 | George |
| 6,390,321 | B1 | 5/2002 | Wang |
| 6,401,958 | B1 | 6/2002 | Foss et al. |
| 6,519,130 | B1 | 2/2003 | Breslow |
| 6,557,716 | B1 | 5/2003 | Chan |
| D476,456 | S | 6/2003 | Englert et al. |
| 6,596,983 | B2 | 7/2003 | Brent |
| 6,626,316 | B2 | 9/2003 | Yang |
| 6,626,317 | B2 | 9/2003 | Pfiefer et al. |
| 6,632,064 | B1 | 10/2003 | Walker et al. |
| D482,169 | S | 11/2003 | Lin |
| 6,659,407 | B2 | 12/2003 | Asaro |
| 6,681,950 | B2 | 1/2004 | Miller, Jr. et al. |
| D488,604 | S | 4/2004 | Yang et al. |
| D488,903 | S | 4/2004 | Yang et al. |
| D489,503 | S | 5/2004 | Lin |
| D489,857 | S | 5/2004 | Yang et al. |
| D490,583 | S | 5/2004 | Yang et al. |
| D490,954 | S | 6/2004 | Brand |
| D491,706 | S | 6/2004 | Yang et al. |
| 6,758,366 | B2 | 7/2004 | Bourgund et al. |
| D493,930 | S | 8/2004 | Wang |
| D494,723 | S | 8/2004 | Lin |
| 6,812,655 | B1 | 11/2004 | Wang et al. |
| 6,814,249 | B2 | 11/2004 | Lin |
| D499,450 | S | 12/2004 | Goodman et al. |
| 6,837,393 | B1 | 1/2005 | Kuo |
| 6,857,538 | B2 | 2/2005 | Lin |
| 6,859,005 | B2 | 2/2005 | Boliver |
| D503,021 | S | 3/2005 | Yang et al. |
| 6,866,826 | B2 | 3/2005 | Moore et al. |
| 6,883,676 | B2 | 4/2005 | Lin |
| D507,090 | S | 7/2005 | Yang et al. |
| 6,920,994 | B2 | 7/2005 | Lin |
| 6,974,948 | B1 | 12/2005 | Brent |
| D513,445 | S | 1/2006 | Lin |
| 6,981,606 | B2 | 1/2006 | Yang et al. |
| D517,764 | S | 3/2006 | Wang |
| D517,767 | S | 3/2006 | Yang et al. |
| D518,266 | S | 3/2006 | Yang et al. |
| 7,017,773 | B2 | 3/2006 | Gruber et al. |
| 7,044,323 | B2 | 5/2006 | Yang |
| D525,756 | S | 7/2006 | Yang et al. |
| 7,073,677 | B2 | 7/2006 | Richardson et al. |
| 7,077,283 | B2 | 7/2006 | Yang et al. |
| 7,080,750 | B2 | 7/2006 | Wein et al. |
| 7,086,550 | B2 | 8/2006 | Yang et al. |
| D528,726 | S | 9/2006 | Lin |
| 7,121,421 | B2 | 10/2006 | Yang et al. |
| D531,499 | S | 11/2006 | Zaidman |
| D535,799 | S | 1/2007 | Epps |
| D535,800 | S | 1/2007 | Yang et al. |
| D537,223 | S | 2/2007 | Lin |
| D537,599 | S | 2/2007 | Lin |
| D537,601 | S | 2/2007 | Lin |
| D537,999 | S | 3/2007 | Lin |
| D538,995 | S | 3/2007 | Lin |
| D539,498 | S | 3/2007 | Yang et al. |
| D539,499 | S | 3/2007 | Yang et al. |
| D540,001 | S | 4/2007 | Zimmerman |
| D542,001 | S | 5/2007 | Yang et al |
| D542,995 | S | 5/2007 | Lin |
| D543,673 | S | 5/2007 | Yang et al. |
| D544,170 | S | 6/2007 | Lin |
| D544,171 | S | 6/2007 | Lin |
| D544,671 | S | 6/2007 | Saunders et al. |
| D545,024 | S | 6/2007 | Liao |
| 7,225,943 | B2 | 6/2007 | Yang et al. |
| D547,020 | S | 7/2007 | Chen |
| 7,243,811 | B1 | 7/2007 | Ramsey |
| D550,918 | S | 9/2007 | Wang et al. |
| D552,319 | S | 10/2007 | Gusdorf |
| D552,321 | S | 10/2007 | Yang et al. |
| D552,823 | S | 10/2007 | Yang et al. |
| D552,824 | S | 10/2007 | Zimmerman |
| D552,825 | S | 10/2007 | Yang et al. |
| D555,320 | S | 11/2007 | Yang et al. |
| D559,494 | S | 1/2008 | Yang et al. |
| D559,495 | S | 1/2008 | Yang et al. |
| D562,522 | S | 2/2008 | Daams |
| 7,328,842 | B2 | 2/2008 | Wagner et al. |
| D564,169 | S | 3/2008 | Wang |
| D564,723 | S | 3/2008 | Yang et al. |
| D566,367 | S | 4/2008 | Lin |
| D566,369 | S | 4/2008 | Shek |
| D566,923 | S | 4/2008 | Lin |
| D567,468 | S | 4/2008 | Yang et al. |
| D568,572 | S | 5/2008 | Yang et al. |
| 7,374,060 | B2 | 5/2008 | Yang et al. |
| D571,520 | S | 6/2008 | Lin |
| 7,398,913 | B2 | 7/2008 | McClure |
| 7,404,499 | B1 | 7/2008 | Ramsey |
| D574,569 | S | 8/2008 | Yang et al. |
| D576,371 | S | 9/2008 | Zimmerman |
| D578,265 | S | 10/2008 | Presnell |
| D578,266 | S | 10/2008 | Yang et al. |
| D578,268 | S | 10/2008 | Yang et al. |
| D578,722 | S | 10/2008 | Yang et al. |
| 7,438,199 | B1 | 10/2008 | Tidrick |
| D580,120 | S | 11/2008 | Lin |
| D580,613 | S | 11/2008 | Yang et al. |
| D580,615 | S | 11/2008 | Yang et al. |
| D581,622 | S | 11/2008 | Presnell et al. |
| D584,470 | S | 1/2009 | Bizzell et al. |
| D585,171 | S | 1/2009 | Bizzell et al. |
| D585,618 | S | 1/2009 | Yang et al. |
| D586,070 | S | 2/2009 | Lin |
| 7,494,021 | B2 | 2/2009 | Yang et al. |
| D587,874 | S | 3/2009 | Lin |
| D593,271 | S | 5/2009 | Yang et al. |
| 7,540,396 | B2 | 6/2009 | Yang et al. |
| 7,543,716 | B2 | 6/2009 | Lin |
| 7,559,433 | B2 | 7/2009 | Yang et al. |
| D599,074 | S | 8/2009 | Bizzell et al. |
| D603,119 | S | 10/2009 | Yang et al. |
| 7,607,552 | B2 | 10/2009 | Efstathiou |
| D604,472 | S | 11/2009 | Blanks et al. |
| 7,614,519 | B2 | 11/2009 | Krauth et al. |
| 7,621,420 | B2 | 11/2009 | Bandoh et al. |
| 7,656,109 | B2 | 2/2010 | Yang et al. |
| D611,216 | S | 3/2010 | Yang et al. |
| D611,217 | S | 3/2010 | Bizzell et al. |
| D611,671 | S | 3/2010 | Yang et al. |
| 7,694,838 | B2 | 4/2010 | Yang et al. |
| 7,703,622 | B1 | 4/2010 | Bynoe |
| D615,270 | S | 5/2010 | Yang et al. |
| D615,722 | S | 5/2010 | Yang et al. |
| 7,712,285 | B2 | 5/2010 | Stravitz et al. |
| 7,741,801 | B2 | 6/2010 | Fukuizumi |
| 7,748,556 | B2 | 7/2010 | Yang et al. |
| 7,781,995 | B2 | 8/2010 | Yang et al. |
| D623,817 | S | 9/2010 | Yang et al. |
| D625,068 | S | 10/2010 | Shannon |
| 7,806,285 | B2 | 10/2010 | Yang et al. |
| D627,533 | S | 11/2010 | Yang et al. |
| D627,944 | S | 11/2010 | Wang et al. |
| D629,172 | S | 12/2010 | Liao |
| D630,404 | S | 1/2011 | Yang et al. |
| D631,221 | S | 1/2011 | Yang et al. |
| D632,864 | S | 2/2011 | Yang et al. |
| D634,911 | S | 3/2011 | Yang et al. |
| D635,319 | S | 3/2011 | Meyerhoffer |
| 7,896,187 | B2 | 3/2011 | Haibel |
| 7,922,024 | B2 | 4/2011 | Yang et al. |
| 7,950,543 | B2 | 5/2011 | Yang et al. |
| D644,390 | S | 8/2011 | Smeets et al. |
| 7,992,742 | B1 | 8/2011 | Kim |
| 8,006,857 | B2 | 8/2011 | Lin |
| D644,806 | S | 9/2011 | Yang et al. |

(56) References Cited

U.S. PATENT DOCUMENTS

| | | | |
|---|---|---|---|
| D644,807 | S | 9/2011 | Yang et al. |
| D649,728 | S | 11/2011 | Campbell |
| 8,074,833 | B2 | 12/2011 | Yang et al. |
| 8,096,445 | B2 | 1/2012 | Yang et al. |
| 8,136,688 | B2 | 3/2012 | Lee et al. |
| D657,108 | S | 4/2012 | Yang et al. |
| D657,109 | S | 4/2012 | Liao |
| 8,297,470 | B2 | 10/2012 | Yang et al. |
| D672,520 | S | 12/2012 | Yang et al. |
| D673,750 | S | 1/2013 | Quan |
| D675,802 | S | 2/2013 | Yang et al. |
| D675,803 | S | 2/2013 | Yang et al. |
| 8,418,869 | B2 | 4/2013 | Yang et al. |
| D689,255 | S | 9/2013 | Sun Ting Kung et al. |
| 8,567,630 | B2 | 10/2013 | Yang et al. |
| 8,569,980 | B2 | 10/2013 | Yang et al. |
| 8,672,171 | B2 | 3/2014 | Wynn et al. |
| 8,686,676 | B2 | 4/2014 | Yang et al. |
| 8,716,969 | B2 | 5/2014 | Yang et al. |
| 8,720,728 | B2 | 5/2014 | Yang et al. |
| 8,766,582 | B2 | 7/2014 | Yang et al. |
| D714,510 | S | 9/2014 | Yang et al. |
| D716,015 | S | 10/2014 | van de Leest |
| 8,872,459 | B2 | 10/2014 | Yang et al. |
| 2001/0002690 | A1 | 6/2001 | Rosky |
| 2001/0020619 | A1 | 9/2001 | Pfeifer et al. |
| 2002/0079315 | A1 | 6/2002 | Yang |
| 2002/0092853 | A1 | 7/2002 | Wang |
| 2002/0096524 | A1 | 7/2002 | Hardesty |
| 2002/0104266 | A1 | 8/2002 | Ranaudo |
| 2003/0089719 | A1 | 5/2003 | Berger |
| 2003/0201265 | A1 | 10/2003 | Lin |
| 2003/0201267 | A1 | 10/2003 | Yang et al. |
| 2003/0230576 | A1 | 12/2003 | Lin |
| 2004/0004080 | A1 | 1/2004 | Yang et al. |
| 2004/0016756 | A1 | 1/2004 | Lin |
| 2004/0020927 | A1 | 2/2004 | Yang et al. |
| 2004/0134924 | A1 | 7/2004 | Hansen et al. |
| 2004/0140782 | A1 | 7/2004 | Okabe et al. |
| 2004/0164077 | A1 | 8/2004 | Kuo |
| 2004/0174268 | A1 | 9/2004 | Scott et al. |
| 2004/0175303 | A1 | 9/2004 | Lin |
| 2004/0199401 | A1 | 10/2004 | Wagner |
| 2004/0200938 | A1 | 10/2004 | Forlivio |
| 2004/0206758 | A1 | 10/2004 | Lin |
| 2004/0206760 | A1 | 10/2004 | Gagnebin |
| 2004/0251746 | A1 | 12/2004 | Ichimaru et al. |
| 2005/0017006 | A1 | 1/2005 | Kuo |
| 2005/0017010 | A1 | 1/2005 | Siegel et al. |
| 2005/0103788 | A1 | 5/2005 | Yang et al. |
| 2005/0133506 | A1 | 6/2005 | Yang et al. |
| 2005/0230396 | A1 | 10/2005 | Yang et al. |
| 2005/0230397 | A1 | 10/2005 | Yang et al. |
| 2005/0258794 | A1 | 11/2005 | Fukuizumi |
| 2005/0284870 | A1 | 12/2005 | Yang et al. |
| 2006/0027579 | A1 | 2/2006 | Yang et al. |
| 2006/0056741 | A1 | 3/2006 | Yang et al. |
| 2006/0103086 | A1 | 5/2006 | Niemeyer et al. |
| 2006/0175336 | A1 | 8/2006 | Wang |
| 2006/0186121 | A1 | 8/2006 | Yang et al. |
| 2006/0196874 | A1 | 9/2006 | Yang |
| 2006/0213910 | A1 | 9/2006 | Yang et al. |
| 2006/0226149 | A1 | 10/2006 | Yang et al. |
| 2006/0249510 | A1 | 11/2006 | Lin |
| 2006/0255033 | A1 | 11/2006 | Yang et al. |
| 2006/0261071 | A1 | 11/2006 | Yang et al. |
| 2006/0278643 | A1 | 12/2006 | Chiou |
| 2007/0012699 | A1 | 1/2007 | Yang et al. |
| 2007/0029323 | A1 | 2/2007 | Yang et al. |
| 2007/0034334 | A1 | 2/2007 | Ramsey et al. |
| 2007/0090112 | A1 | 4/2007 | Kalman et al. |
| 2007/0114847 | A1 | 5/2007 | Ichimaru et al. |
| 2007/0181579 | A1 | 8/2007 | Kuo et al. |
| 2007/0182551 | A1 | 8/2007 | Yang et al. |
| 2007/0205195 | A1 | 9/2007 | Yang et al. |
| 2007/0209846 | A1 | 9/2007 | Wilson |
| 2007/0241109 | A1 | 10/2007 | Lin |
| 2007/0266637 | A1 | 11/2007 | McGowan |
| 2007/0272691 | A1 | 11/2007 | Wang et al. |
| 2007/0289972 | A1 | 12/2007 | Wynn et al. |
| 2008/0011754 | A1 | 1/2008 | Ramsey |
| 2008/0011910 | A1 | 1/2008 | Ramsey |
| 2008/0083756 | A1 | 4/2008 | Daniels |
| 2008/0099274 | A1 | 5/2008 | Seel |
| 2008/0128428 | A1 | 6/2008 | Beckerman |
| 2008/0164257 | A1 | 7/2008 | Boll et al. |
| 2008/0236275 | A1 | 10/2008 | Breed et al. |
| 2008/0237234 | A1 | 10/2008 | Yang et al. |
| 2008/0257889 | A1 | 10/2008 | Kovacevich et al. |
| 2008/0257890 | A1 | 10/2008 | Kovacevich et al. |
| 2008/0257891 | A1 | 10/2008 | Kovacevich et al. |
| 2008/0264948 | A1 | 10/2008 | Kovacevich et al. |
| 2008/0264950 | A1 | 10/2008 | Kovacevich et al. |
| 2008/0272119 | A1 | 11/2008 | Efstathiou |
| 2008/0272127 | A1 | 11/2008 | Kovacevich et al. |
| 2009/0084788 | A1 | 4/2009 | Yang et al. |
| 2009/0136341 | A1 | 5/2009 | Kenyon |
| 2009/0194532 | A1 | 8/2009 | Yang et al. |
| 2009/0230131 | A1 | 9/2009 | McDuffie et al. |
| 2009/0261105 | A1 | 10/2009 | Cunningham et al. |
| 2009/0266836 | A1 | 10/2009 | Mobley |
| 2010/0006572 | A1 | 1/2010 | Chiou |
| 2010/0084235 | A1 | 4/2010 | Lu |
| 2010/0096894 | A1 | 4/2010 | Fukai |
| 2010/0122985 | A1 | 5/2010 | Peters et al. |
| 2010/0170904 | A1 | 7/2010 | Kalman et al. |
| 2010/0224627 | A1 | 9/2010 | Yang et al. |
| 2010/0237074 | A1 | 9/2010 | Yang et al. |
| 2010/0252557 | A1 | 10/2010 | Clements |
| 2010/0294769 | A1* | 11/2010 | Lee et al. ..... 220/263 |
| 2011/0139781 | A1 | 6/2011 | Jin et al. |
| 2011/0220646 | A1 | 9/2011 | Yang et al. |
| 2011/0220647 | A1 | 9/2011 | Yang et al. |
| 2011/0220648 | A1 | 9/2011 | Yang et al. |
| 2011/0220655 | A1 | 9/2011 | Yang et al. |
| 2011/0272409 | A1 | 11/2011 | Kasbohm |
| 2013/0098913 | A1 | 4/2013 | Yang et al. |
| 2013/0233853 | A1 | 9/2013 | Yang et al. |
| 2013/0233857 | A1 | 9/2013 | Yang et al. |
| 2013/0248532 | A1 | 9/2013 | Yang et al. |
| 2014/0246434 | A1 | 9/2014 | Yang et al. |
| 2014/0345453 | A1 | 11/2014 | Oh et al. |

FOREIGN PATENT DOCUMENTS

| | | | |
|---|---|---|---|
| CA | 132181 | | 6/2010 |
| CA | 136938 | | 5/2011 |
| CA | 141819 | | 4/2012 |
| CA | 146601 | | 2/2013 |
| CA | 152797 | | 4/2014 |
| CN | 102190144 | A | 9/2011 |
| CN | 301947175 | S | 6/2012 |
| CN | 201130284559 | | 6/2012 |
| CN | 103300590 | A | 9/2013 |
| CN | 302771721 | S | 3/2014 |
| CN | 201330418089.X | | 3/2014 |
| CN | 104016030 | A | 9/2014 |
| DE | 1610087 | | 6/1950 |
| DE | 822376 | | 11/1951 |
| DE | 1283741 | | 7/1966 |
| DE | 8436939 | | 3/1985 |
| DE | 9108341 | | 10/1991 |
| DE | 4225936 | A1 | 2/1994 |
| DE | 19525885 | | 3/1997 |
| DE | 19617823 | | 11/1997 |
| DE | 19809331 | | 5/1999 |
| DE | 29918687 | | 3/2000 |
| DE | 19933180 | | 1/2001 |
| DE | 10148997 | | 4/2003 |
| DE | 20217561 | | 3/2004 |
| EP | 0582240 | | 7/1993 |
| EP | 0903305 | A1 | 3/1999 |
| EP | 0906876 | | 4/1999 |
| EP | 1094017 | B1 | 3/2003 |

(56) References Cited

FOREIGN PATENT DOCUMENTS

| | | | | |
|---|---|---|---|---|
| EP | 1361176 | | 11/2003 | |
| EP | 1136393 | | 4/2004 | |
| EP | 1447342 | A2 | 8/2004 | |
| EP | 1600373 | A2 | 11/2005 | |
| EP | 1647503 | A1 | 4/2006 | |
| EP | 1686073 | | 8/2006 | |
| EP | 1918223 | A1 | 5/2008 | |
| EP | 1700799 | B1 | 8/2009 | |
| EP | 001164826-0001 | | 9/2009 | |
| EP | 001232904-0001 | | 10/2010 | |
| EP | 001908575-0001 | | 8/2011 | |
| EP | 001317416-0001 | | 4/2012 | |
| EP | 001317416-0002 | | 4/2012 | |
| EP | 001335285-0001 | | 7/2012 | |
| EP | 001335293-0001 | | 7/2012 | |
| EP | 001381636-001 | | 8/2013 | |
| EP | 001381792-0001 | | 8/2013 | |
| EP | 2636611 | A1 | 9/2013 | |
| EP | 2636613 | A1 | 9/2013 | |
| EP | 1420590-0001 | | 9/2014 | |
| EP | 2772454 | A2 | 9/2014 | |
| FR | 2887152 | | 12/2006 | |
| GB | 191004921 | | 0/1910 | |
| GB | 2329822 | A * | 4/1999 | ..... B65F 1/16 |
| GB | 2384418 | | 7/2003 | |
| JP | 02 152670 | | 6/1990 | |
| JP | H06-56011 | | 8/1994 | |
| JP | 06-272888 | | 9/1994 | |
| JP | D1300450 | | 5/2007 | |
| JP | D1300451 | | 5/2007 | |
| JP | D1322056 | | 2/2008 | |
| KR | 3003841370000 | | 6/2005 | |
| KR | 3004095430000 | | 3/2006 | |
| KR | 3004095430001 | | 7/2006 | |
| NL | 6908550 | | 12/1970 | |
| TW | D112733 | | 9/2006 | |
| TW | D129485 | | 7/2009 | |
| TW | D133382 | | 2/2010 | |
| TW | D133678 | | 3/2010 | |
| TW | D147147 | | 5/2012 | |
| TW | D154797 | | 7/2013 | |
| TW | D158187 | | 1/2014 | |
| TW | D161587 | | 7/2014 | |
| WO | WO 92/02430 | | 2/1992 | |
| WO | WO 96/33671 | | 10/1996 | |
| WO | WO 2005/080232 | A1 | 9/2005 | |
| WO | WO 2006-079263 | | 8/2006 | |
| WO | WO 2007/139570 | | 12/2007 | |
| WO | WO 2009/114495 | | 9/2009 | |

OTHER PUBLICATIONS

European Search Report for Application No. EP 10002273, dated Jan. 4, 2011, in 9 pages.

European Search Report for European Application No. EP 06010394, dated Aug. 24, 2006, in 1 page.

Partial European Search Report for Application No. EP 10002273, dated Jul. 2, 2010, in 4 pages.

Search Report for Taiwan Design Patent Application No. 097304453, dated Apr. 22, 2009.

Search Report for Taiwan Design Patent Application No. 099304439, dated Jul. 1, 2011, in 1 page.

Trento Corner 23 Trash Can, Hailo product brochure, http://www.hailo.de/html/default.asp?site=12_71_107&lang=en.

U.S. Appl. No. 13/783,149, filed Mar. 1, 2013, Yang et al.

U.S. Appl. No. 29/484,903, filed Mar. 13, 2014, Yang et al.

U.S. Appl. No. 29/484,764, filed Mar. 1, 2013, Yang et al.

Partial European Search Report for European Application No. 14156599.4, dated Jun. 3, 2014, in 5 pages.

Extended European Search Report for European Application No. 14156599.4, dated Oct. 24, 2014, in 10 pages.

* cited by examiner

RECEPTACLE WITH MOTION DAMPER NEAR LID

BACKGROUND

1. Field

This disclosure relates to trash can assemblies, particularly to trash can assemblies that have a mechanism for slowing the closing motion of a lid.

2. Description of the Related Art

A major concern for both the home and the workplace is containing and holding wastes, refuse, and trash until permanent disposal. Trash cans act as containers for holding trash and other wastes that are produced in any typical home or office. Trash and garbage cans often employ lids and covers to contain the trash and its associated odor, to hide the trash from view, and to prevent the trash from contaminating areas beyond the lid.

Conventional trash cans have been improved over the years to make them more user-friendly, sanitary, and hygienic. For example, many trash cans are now provided with a foot pedal positioned adjacent the base of the trash can so that a user can step on the foot pedal to open the lid of the trash can, thereby freeing up the user's hands to deposit trash, or to change the plastic liner or bag that is used to line the trash can. Other trash cans have even provided an interior metal or plastic liner that fits inside the trash can, and which can be removed to be washed.

The foot pedals on some of the conventional trash cans are noisy to use. In particular, stepping on a foot pedal of a conventional trash can often result in a loud banging noise as the lid is forced open immediately, and releasing the step on the foot pedal will also result in another loud banging noise as the lid slams shut under the force of gravity and the weight of the lid. These banging actions also result in wear and tear to the contacting parts.

SUMMARY

In some embodiments, a receptacle assembly includes a body portion with an upper portion and a base portion. The body portion can comprise an interior space. The receptacle assembly can also include a lid portion movably engaged with the body portion. The lid portion is configured to move between an open position and a closed position. The receptacle assembly can also include a pedal portion configured to move the lid portion between the open position and the closed position. A linkage such as a rod can extend from the lid portion to the pedal portion. The receptacle assembly can also include one or more motion dampers configured to interface with the rod and positioned in a region near the lid portion. The motion damper is configured to dampen motion of the lid portion.

A base portion can be removably coupled to the upper portion. The body portion can also include a lower shell portion. The body portion can include a rear shell portion positioned near the lid portion. In some embodiments, the motion damper can be connected to, generally surrounded by, generally housed within, or generally near the rear shell portion. The one or more motion dampers can be positioned exterior to the upper portion of the body portion. The receptacle assembly can include an inner body portion. The inner body portion can comprise an interior space having substantially the same volume as the interior space of the body portion.

The motion damper can include a receiving portion and a piston portion. The receiving portion can define an interior space for receiving the piston portion. The motion damper can include a sealing member. The piston portion of the motion damper is configured to move from a first position, such as a lower position, to a second position, such as an upper position, as the lid portion moves from the closed position to the open position. The piston portion of the motion damper can be configured to move further into a receiving portion of the motion damper as the lid portion moves from the closed position to the open position.

In some embodiments, a method of manufacturing a receptacle assembly can include forming a body portion. The body portion can include an upper portion and a base portion and define an interior space. The method can include movably engaging a lid portion with the body portion. The lid portion is configured to move between an open position and a closed position. The method can also include movably engaging a pedal portion with the body portion. The pedal portion is configured to move the lid portion between the open position and the closed position. The method can also include extending a rod to the lid portion and the pedal portion. The method can also include movably engaging a motion damper with the rod. The motion damper can be configured to dampen motion of the rod and positioned near the lid portion.

In some embodiments, forming the body portion can include removably coupling the base portion to the upper portion, positioning a lower shell portion in the interior space of the body portion, connecting a rear shell portion near the lid portion, connecting the motion damper to, near, or within a rear shell portion of the body portion, and positioning the motion damper exterior to the upper portion of the body portion.

In some embodiments, the method can include inserting an inner body portion into the body portion. The inner body portion can define an interior space having substantially the same volume as the interior space of the body portion. The method can include forming a motion damper including a receiving portion and a piston portion. The receiving portion can define an interior space for receiving the piston portion. The method can include forming a motion damper with a sealing member. A piston portion of the body portion can be configured to move from a lower position to an upper portion position as the lid portion moves from the closed position to the open position. A piston portion of the body portion can be configured to move further into a receiving portion of the motion damper as the lid portion moves from the closed position to the open position.

Any of the receptacle embodiments described herein can include a bag-securing member configured to secure a bag within the interior space of the receptacle. The bag-securing member can be disposed along or near an upper portion of the body portion. The bag-securing member can include an opening having a first opening portion and a second opening portion. The second opening portion can be larger than the first opening portion. In certain embodiments, a bag disposed within the receptacle assembly can be wrapped around a rounded lip of the upper body portion and secured to the receptacle assembly using the bag-securing member.

The bag-securing member can include any of the features described herein. In some embodiments, the first opening can be generally narrow in horizontal width and substantially larger in vertical length than in horizontal width, and the width, length, or diameter of the second opening can be about the same in both the generally horizontal and generally vertical directions, and/or the width, length, and/or diameter of the second opening can be larger than a width and/or length of the first opening. In certain embodiments, a width of the second opening portion can be at least three times a width of the first opening portion. In certain embodiments, the opening can be substantially tear drop shaped. In certain embodiments, the bag-securing member can include an inwardly tapered inner wall portion generally surrounding at least a portion of the opening.

For purposes of summarizing the disclosure, certain aspects, advantages and features of the inventions have been described herein. It is to be understood that not necessarily any or all such advantages are achieved in accordance with any particular embodiment of the inventions disclosed herein. No aspects of this disclosure are essential or indispensable.

BRIEF DESCRIPTION OF THE DRAWINGS

Various embodiments are depicted in the accompanying drawings for illustrative purposes, and should in no way be interpreted as limiting the scope of the embodiments. In addition, various features of different disclosed embodiments can be combined to form additional embodiments, which are part of this disclosure.

FIG. 15 is a rear view of a receptacle assembly including a bag-securing member.

DETAILED DESCRIPTION

A variety of receptacles are described below to illustrate various examples that may be employed to achieve one or more desired improvements. These examples are only illustrative and not intended in any way to restrict the general inventions presented and the various aspects and features of these inventions. Furthermore, the phraseology and terminology used herein is for the purpose of description and should not be regarded as limiting. No features, structure, or step disclosed herein is essential or indispensable.

Figure 1:
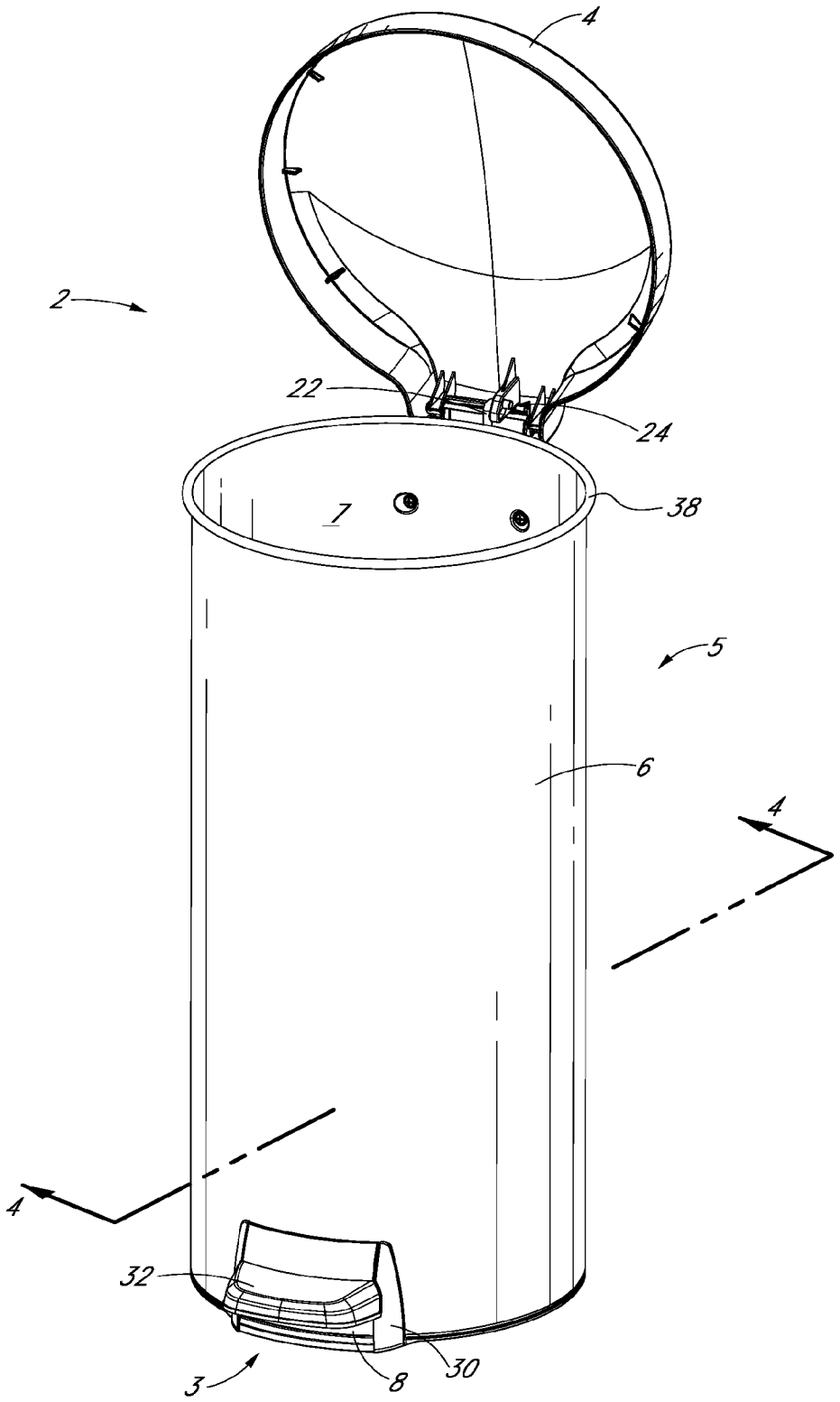
FIG. 1 is a perspective view of an example of a receptacle assembly with the lid in its open position.
Figure 2:
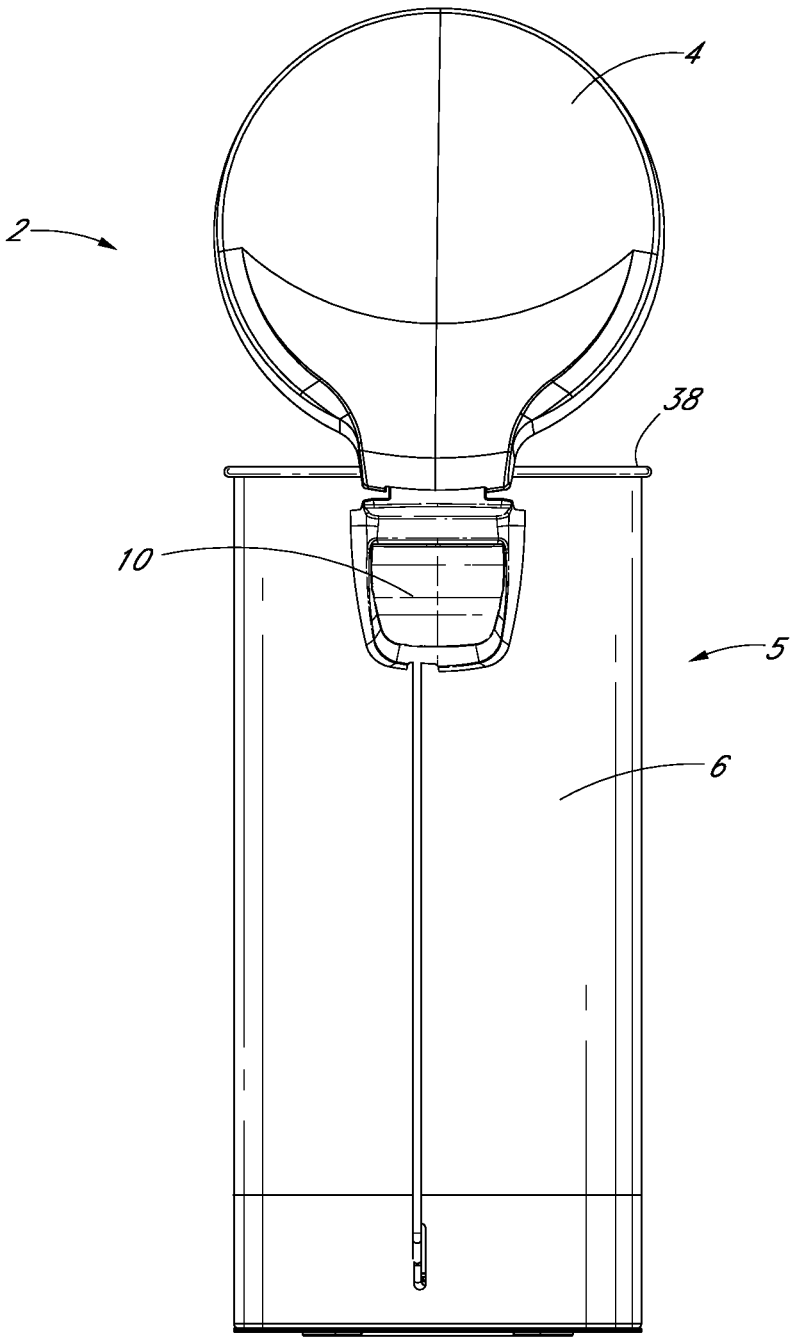
FIG. 2 is a back view of the receptacle assembly illustrated in FIG. 1.
Figure 3:
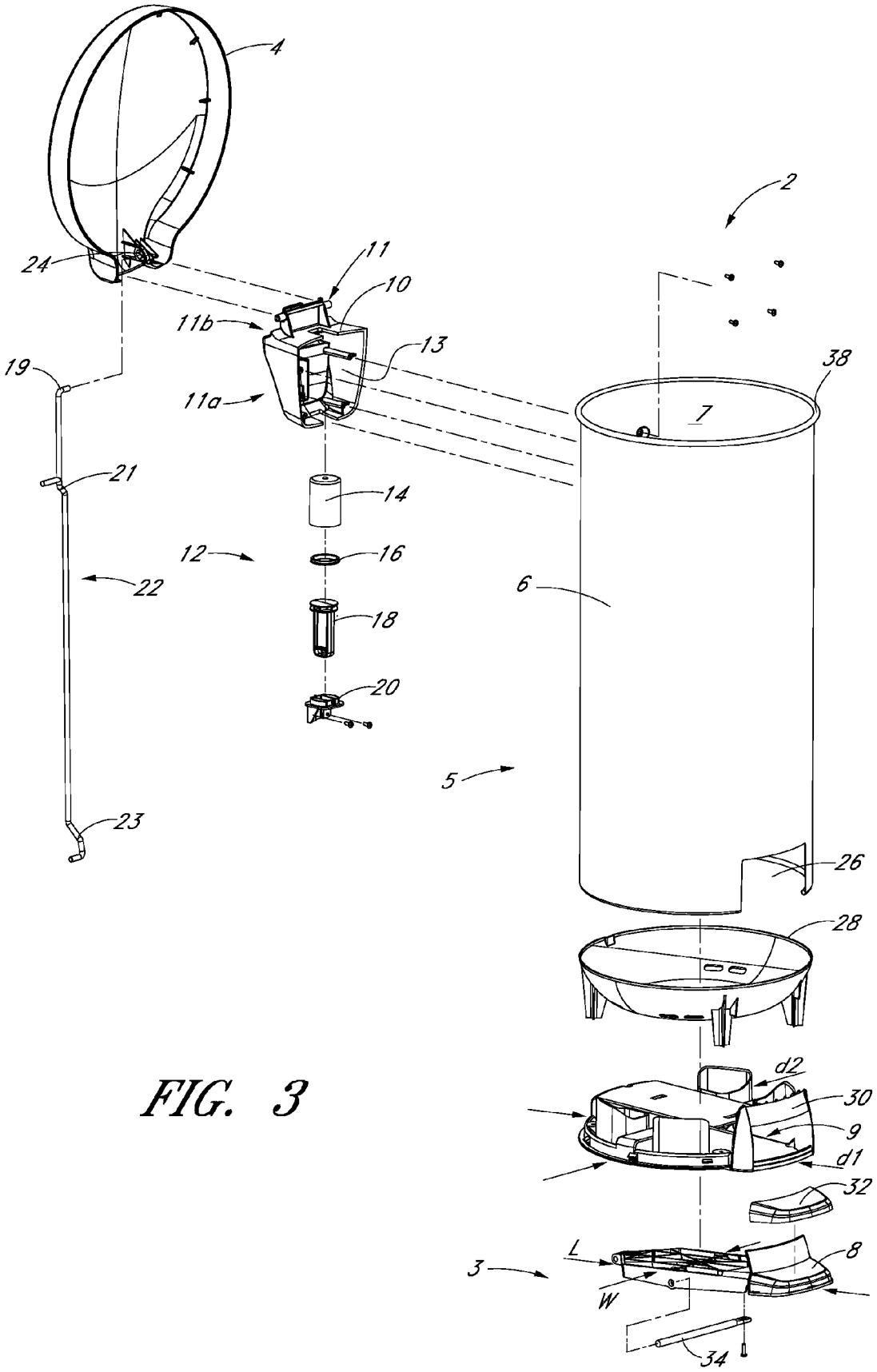
FIG. 3 is an exploded and perspective view of the receptacle assembly illustrated in FIG. 1.

FIGS. 1-3 illustrate a receptacle assembly 2. The assembly can include a body portion 5 and a lid portion 4 as illustrated in FIG. 1. The receptacle assembly 2 can further include a mechanism configured to move the lid portion 4 from a closed to an open position. The lid opening mechanism can include a pedal portion 3 configured to move the lid portion 4 between the closed and open positions when the pedal portion 3 is moved from the resting to the actuated position. As used herein, the phrase "resting position" of the pedal portion 3 refers to a position where the pedal portion 3 normally resides when not being actuated by a user, such as when the pedal portion 3 is pivoted towards an upper position, as illustrated. The actuated position of the pedal portion 3 can refer to where the pedal is located during or upon completion of actuation, such as when the pedal portion 3 is pressed downward, for example, by the foot of a user.

The body portion 5 can include a front region and a rear region. The pedal portion 3 can extend outward from the front region, and the lid portion 4 can connect to the rear region of the body portion 4.

The body portion 5 can include a base portion 30, an upper body portion 6, a lower shell portion 28, and/or a rear shell portion 10. Any two or more of the components of the body portion can be made from a single monolithic piece or from separate pieces connected together. Although FIGS. 1 and 2 illustrate a cylindrical body portion 5, the body portion can be rectangular or any other shape. Any of the body portion components can be formed from sheet metals (e.g., sheet stainless steel or aluminum), other metals, plastics, or other materials. For example, the body portion can include 23-26 gauge stainless sheet shell.

The base portion 30 is configured to support the receptacle assembly 2 in a stable resting position when the receptacle assembly 2 rests on a surface such as a floor, which may be smooth, or uneven. The base portion 30 can be configured to support the upper body portion 6 such that the upper portion 6 can extend upward from the base 30.

The base portion 30 can also provide a mounting arrangement for a pedal portion 3. For example, the base portion 30 can include a receiving portion 9 for receiving at least a part of the pedal portion 3. The receiving portion 9 is large enough to permit the pedal portion 3 to move from the rest position to the actuated position.

As shown in FIG. 3, the pedal portion can include a pedal cover 32, a pedal bar 8, and a pivoting rod 34 about which the pedal bar 8 rotates. The pivoting rod 34 can be secured to a portion of the base portion 30. In some embodiments, the pedal bar 8 can include a length 1 that is generally equal to or longer than a diameter d1 (or length) of the base portion 30. The pedal bar 8 can be configured to extend from a rear region of the base portion 30 and at least partially extend out from the base portion 30. In some embodiments, the pedal bar 8 can include a width w that is greater than or approximately equal to about half of the diameter d2 (or width) of the base portion 30.

In some embodiments, an upper edge of a thin bag or barrier, such as a trash bag, can be attached to an upper region or lip of the receptacle assembly 2, such as a trash can. A body portion of the trash bag can hang downwardly from the attached upper edge into the interior of the trashcan. A bottom region of the trash bag can be positioned near, adjacent to, or in contact with, a generally upwardly facing bottom interior surface of an interior cavity of the trashcan.

In some embodiments, to help provide a generally open, generally unobstructed, generally even distribution of contents (such as trash) inside of the trash bag, and/or inside of the interior cavity of the trashcan (e.g., when no trash bag is used), the generally upwardly facing bottom interior surface of the interior cavity of the receptacle assembly 2 can comprise a generally smooth, generally continuous, generally open, and/or generally unobstructed surface that extends entirely or substantially entirely across the upwardly facing bottom interior surface from one side of the interior of the trashcan to another side of the interior of the trashcan.

In some embodiments, the upwardly facing bottom interior surface can be free of substantial bumps, protrusions, recesses, and/or other features that produce appreciable unevenness, such as dampers, foot pedal components, cross bars, linkage rods, etc. In some embodiments, the upwardly facing bottom interior surface is generally concave or generally bowl-shaped, and can comprise a generally sloped or slanted region (e.g., positioned generally on or around the periphery) and/or a generally flat or generally planar region (e.g., positioned generally horizontally in a central or inner area).

In some embodiments, the upwardly facing bottom interior surface can be a lower shell portion 28 positioned within an interior cavity 7 of the upper body portion 6. The lower shell portion 28 can provide a generally smooth bottom surface for receiving contents of the receptacle assembly 2. For example, the lower shell portion can include a substantially planar upper surface and/or a rounded upper surface (as shown in FIG. 3). In some embodiments, the height of the lower shell portion 28 can be substantially less than the height of the upper body portion 6, positioning the uppermost surface of the lower shell portion substantially closer to the bottom of the receptacle assembly 2 than to the middle and/or top of the receptacle assembly 2. In some embodiments, the height of the lower shell portion 28 can be less than or generally equal to about one-fourth of the height of the upper body portion 6. In certain embodiments, the height of the lower shell portion 28 can be less than or generally equal to about one-eighth of the height of the upper body portion 6.

If the lower shell portion 28 is a separate component from the base portion 30, the lower shell portion can include one or more first attachment structures, such as one or more projections 35 or openings, for engaging with one or more second attachment structures, such as corresponding projections or openings 36, of the base portion 30.

The upper body portion 6 extends upward from the base portion 30 and can include the interior cavity 7 for receiving the lower shell portion 28. The upper body portion can also include an opening 26 for receiving a portion of the pedal portion 3. In some embodiments, there is a generally rigid liner or contents bucket (not shown) positioned within or substantially within the interior cavity 7, which is configured to receive a contents bag (such as a trash can) therein that is removably attached along an upper edge of the liner or bucket. In some embodiments, as illustrated, the receptacle assembly 2 does not include or does not require the inclusion of a liner or bucket to provide an attachment region or a support for the contents bag. Rather, in some embodiments, the receptacle assembly 2 is configured to attach directly to the contents bag, such as long an upper edge or region thereof, below the lid. The top edge of the main body of the receptacle assembly 2 can be turned or bent outwardly and/or be generally smooth or rounded or otherwise provide an attachment surface that is configured to avoid tearing the contents bag. In some embodiments, a portion of the receptacle assembly 2 can comprise a small, generally round or slotted aperture through which a portion of the contents bag can be inserted to removably secure the contents bag to the receptacle assembly 2.

The rear shell portion 10 can be connected to a rear region of the upper body portion 6 such that the rear shell portion 10 is positioned on an opposite side from the pedal portion 3 extending outward from the receptacle assembly 2. The rear shell portion 10 can be positioned exterior to the upper body portion 6 and/or near the lid portion 4. A bottom portion 11*a* of the rear shell portion 10 can be connected to the upper body portion 6, while an upper portion 11*b* of the rear shell portion 10 is connected to the lid portion 4.

The lid portion 4 can be moveably engaged with the body portion 5 with any known device, such as a hinge 11 which can allow pivoting motion of the lid portion 4, or other devices providing different movements. The connection between the lid portion 4 and body portion 5 can be constructed so as to connect the lid portion 4 to the rear shell portion 10 or directly to the upper body portion 6.

A force-communicating linkage such as a rod 22 can extend from a region at or near the pedal portion 3 to a region at or near the lid portion 4. In some embodiments, the rod 22 can include a first portion 23, a second portion 19, and/or a third portion 21. The rod 22 can include an elongate structure having a longitudinal axis substantially parallel to the longitudinal axis of the receptacle assembly 2. Each of the first portion 23, the second portion 19, and/or the third portion 21 can include a projecting portion projecting along an axis that is generally perpendicular to the longitudinal axis of the rod 22. The first portion 23 can include a generally horizontal projection at a first end of the rod 22 and slanted portion displacing the horizontal projection from the longitudinal axis of the rod 22. The second portion 19 can include a generally horizontal projection at a second end of the rod 22. The third portion 21 can include a horizontal projection and a slanted portion displacing the horizontal projection and second portion from the longitudinal axis of the rod 22.

Figure 5:
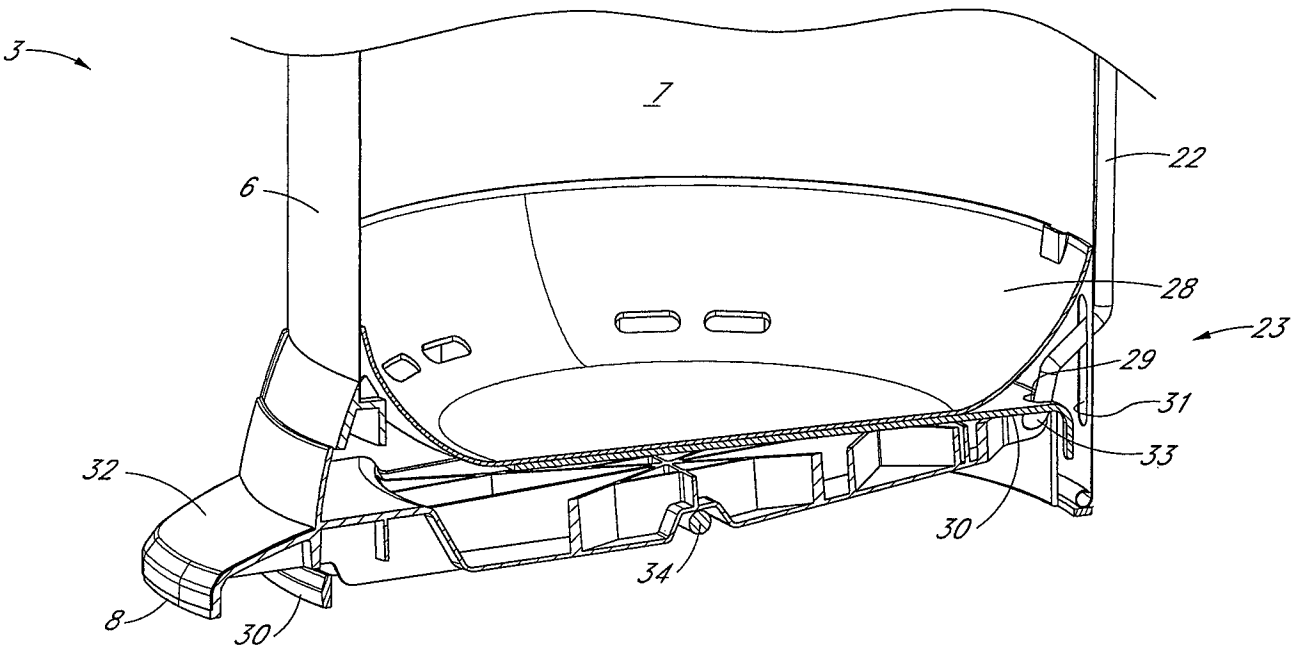
FIG. 5 is a sectional view of the bottom portion illustrated in FIG. 4 during actuation of the pedal.
Figure 6:
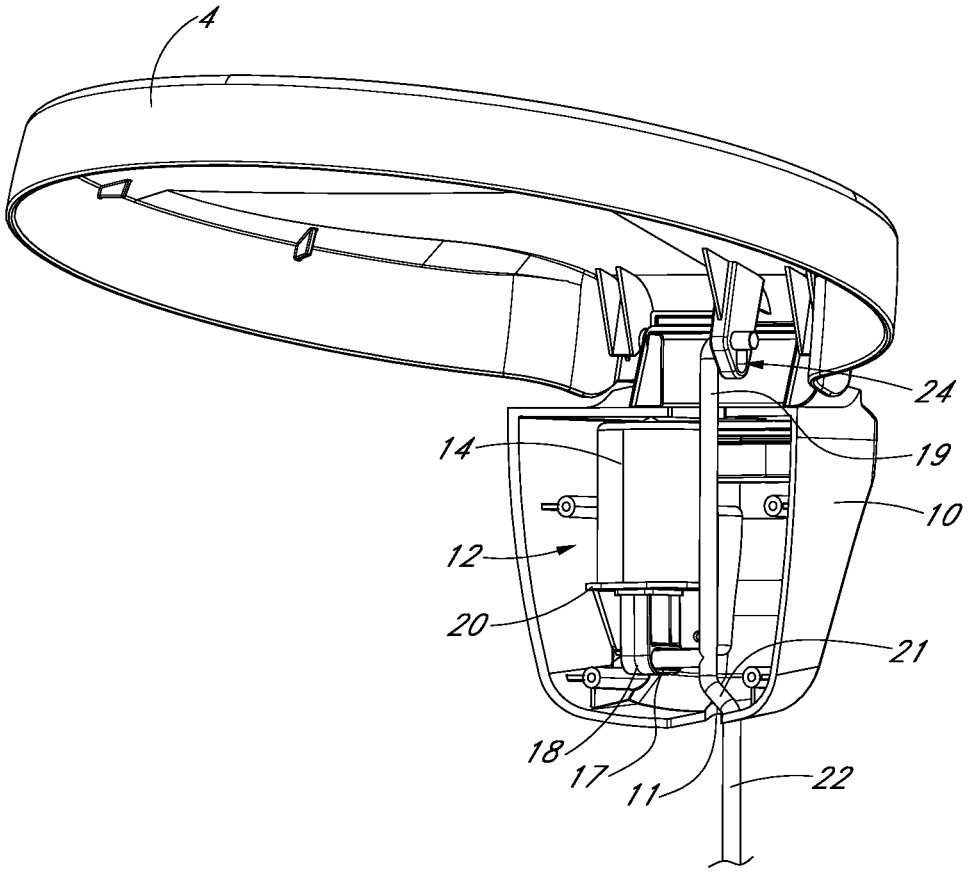
FIG. 6 is an enlarged view of a top portion of the receptacle assembly illustrated in FIG. 1 with the lid in its closed position.
Figure 7:
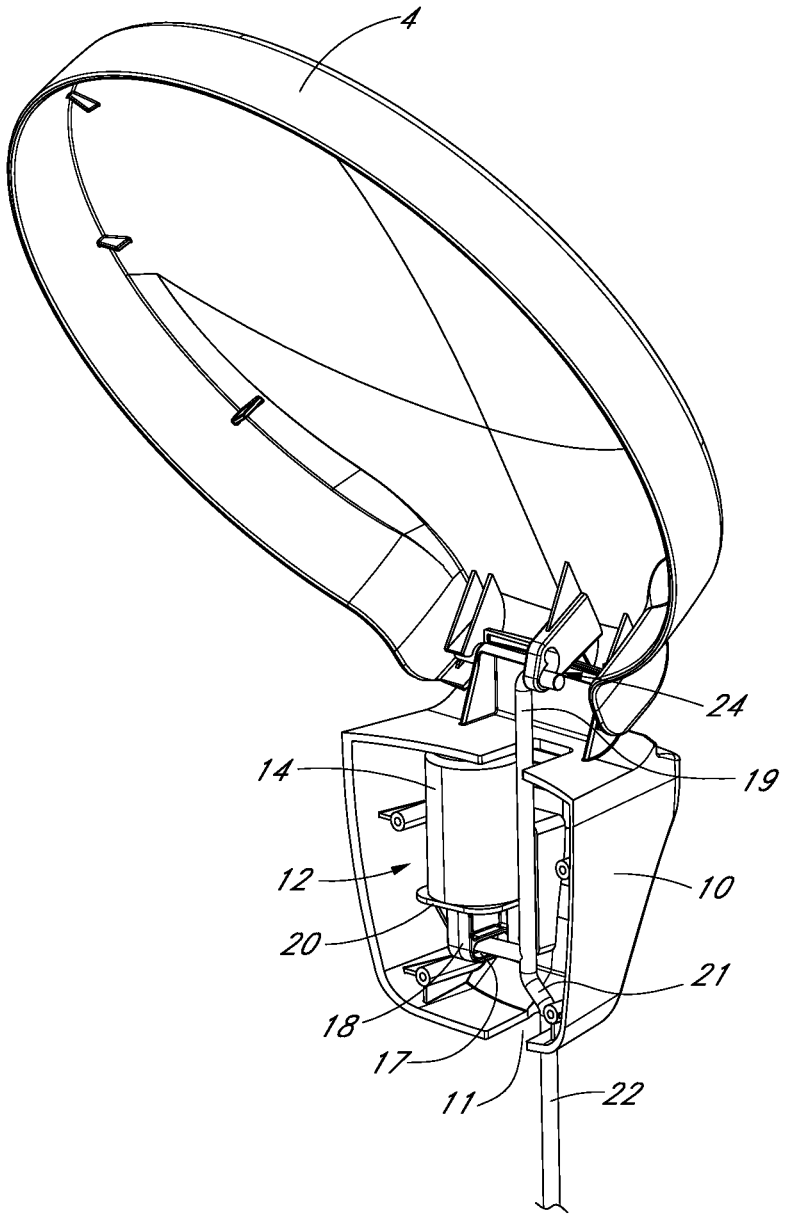
FIG. 7 is an enlarged view of the top portion of the receptacle assembly illustrated in FIG. 1 when the lid is in its open position.

A first portion 23 of the rod 22 can be configured to contact, interface with, and/or or be in operable communication with, the pedal portion 3. For example, a rear region of the pedal bar 8 can include an engaging portion, such as a notch or opening 33, for engaging the first portion 23 of the rod 22 (FIGS. 4-5) and the lid portion 4 can engage a second portion 19 of the rod 22 (FIGS. 6-7). For example, the opening 33 can engage the horizontal projecting portion of the first portion 23 and the horizontal projecting portion of the second portion 19 can movably engage the lid portion 4.

A second portion 19 of the rod 22 can be configured to interface with the lid portion 4 so as to pivot the lid portion 4 relative to the body portion 5. For example, the lid portion 4 can include an engagement region, such as a tabbed portion 24, for movably engaging the rod 22. The tabbed portion 24 can include an opening through which at least a part of the second portion 19 of the rod 22 extends. As the rod 22 moves upward (e.g., when the pedal is pressed downward), the second portion 19 can press against a portion of the lid portion 4 radially offset from a pivot axis defined by the hinge 11 connecting the lid portion 4 to the body portion 5. The radially offset contact between the second portion 19 and the lid portion 4 can cause the lid portion 4 to pivot about the hinge.

The lid portion 4 can engage the second portion 19 of the rod 22 in a hinge-type arrangement. The second portion 19 can pivot within a hinge portion of the lid, and thus move the lid portion 4 between its open and closed positions, as the rod 22 is moved upward and downward in accordance with the movement of the pedal portion 3.

Figure 4:
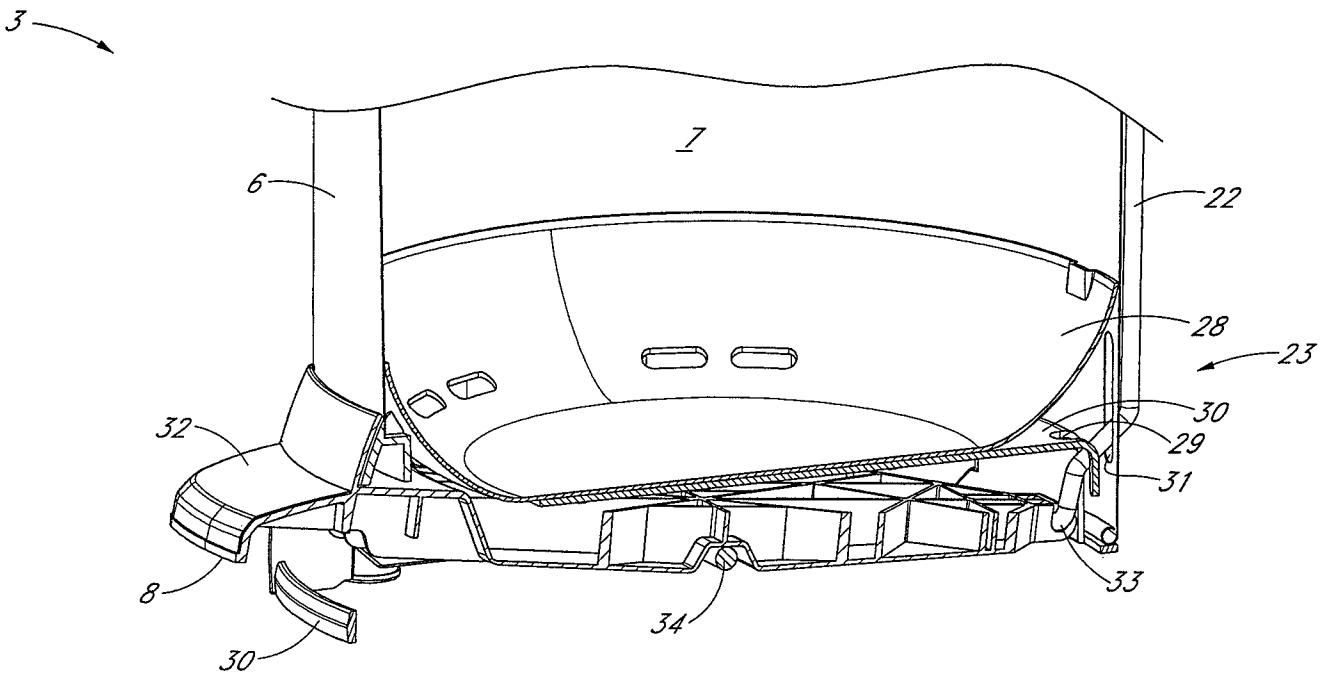
FIG. 4 is a sectional view of a bottom portion of the receptacle assembly of FIG. 1 taken along line 4-4 when the pedal is at rest.

The first portion 23 of the rod 22 can extend from the interior cavity 7 of the body portion 5 to an exterior of the body portion 5. The second portion 19 can extend back into the interior cavity 7 of the body portion 5 or into an interior space 13 defined by the rear shell portion 10. As shown in FIGS. 4-5, the slanted portion of first portion 23 of the rod 22 can extend from the pedal bar 8 and through an opening 29 of the base portion 30 and through an opening 31 along the rear region of the upper body portion 6 to the exterior of the body portion 5. Referring to FIGS. 6-7, the slanted portion of the third portion 21 of the rod 22 can extend through an opening 11 in the rear shell portion 10 and the second portion 22 can movably engage the tabbed portion 24.

The receptacle assembly 2 can also include an inner body portion (not shown). The inner body portion can be positioned within the interior cavity 7 of the upper body portion. The inner body portion can include a sidewall portion and a bottom wall. The bottom wall can provide a generally smooth surface, such as a substantially planar or round surface. In some embodiments, the inner body portion can include an interior volume that is equal to at least a majority of the volume defined by the upper body portion. In some embodiments, the at least a majority of the volume is substantially the entire volume.

If the receptacle assembly 2 includes an inner body portion, the rod 22 may extend from the pedal portion 3 to the lid portion 4 without extending out to the receptacle exterior. The rod 22 can be positioned within the interior cavity 7 of the upper body portion and exterior to the inner body portion.

The resting position of the pedal portion 3 can be a position in which the pedal portion 3 is pivoted upward such that the rod 22 is also pulled into a downward position, which can also correspond to the lid portion 4 being in a closed position (see, e.g., FIGS. 4 and 6). When a user steps on the pedal portion 3, thereby pivoting the pedal portion 3 downward, the rod 22 lifts and moves the lid portion 4 from the closed position toward the open position (FIGS. 5 and 7).

The lid portion 4 and the pedal portion 3 can be biased toward the closed and resting positions, respectively, by way of various devices or configurations. For example, the weight of the lid portion 4 can be sufficient to move the lid portion 4 toward the closed position when nothing (other than gravity) is acting against the pedal portion 3. In some embodiments, springs can be added to the receptacle assembly 2, in any suitable configuration, to bias the lid portion 4 toward the closed position, and/or the pedal portion 3 to the resting position.

The receptacle assembly 2 can include one or more dampening devices 12. As shown in FIG. 3, the receptacle assembly can include a single motion damper 12. The motion damper 12 can dampen the lid portion 4 motion in the upward and/or downward direction. Although the motion damper described below largely dampens the lid motion in the downward direction, many other motion dampening mechanisms can be used, including but not limited to any described in U.S. Pub. No. 2010/0224627, filed Mar. 6, 2009, which is hereby incorporated by reference in its entirety. The motion damper 12 can be any type of dampening device including, for example, but without limitation, rotary dampening devices, friction dampening devices, or fluid damping devices operating with liquid or gaseous working fluids. Other types of dampening mechanisms can also be used.

Figure 8:
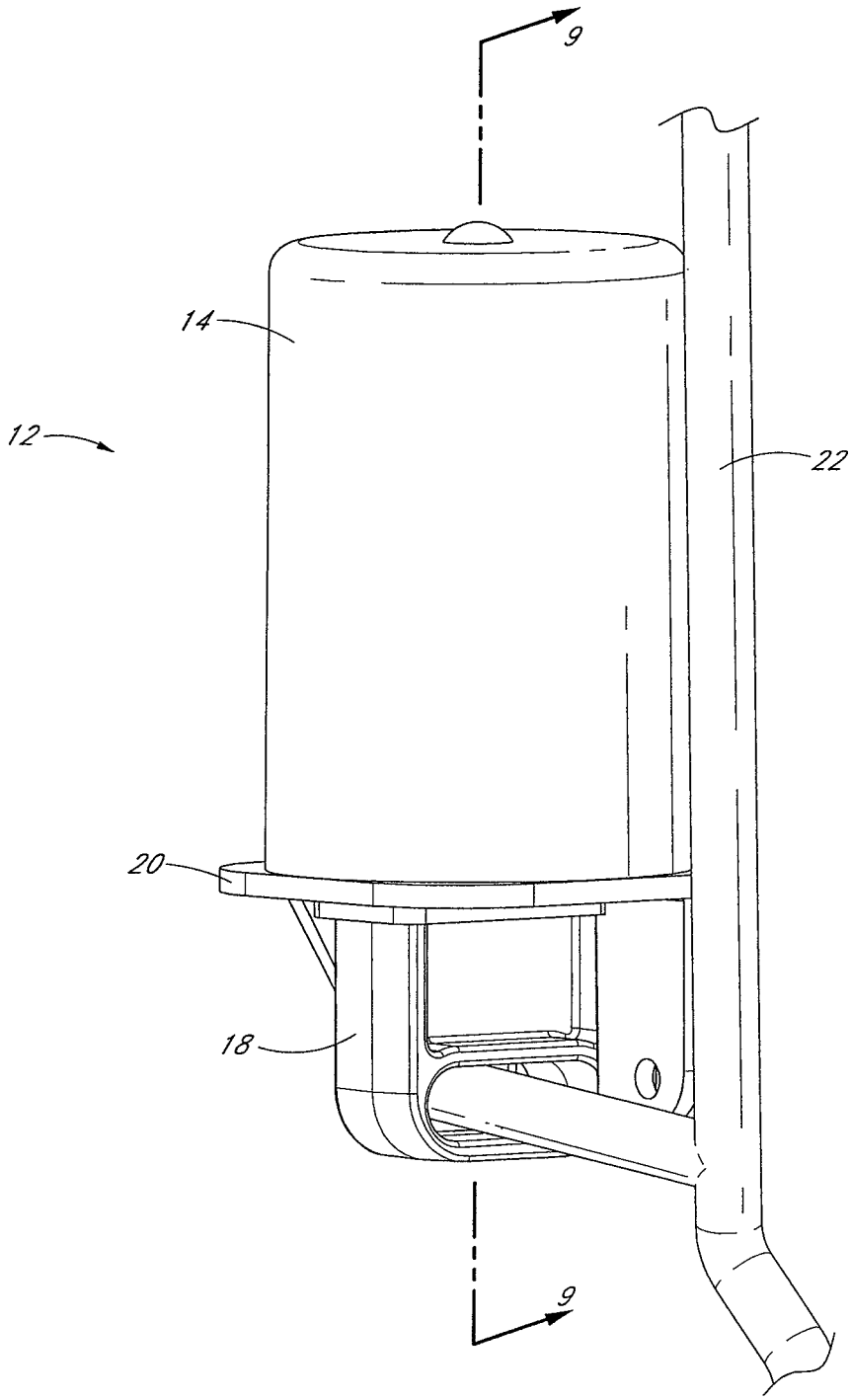
FIG. 8 is an enlarged perspective view of a dampening mechanism that can be used with the receptacle assembly illustrated in FIG. 1.
Figure 9:
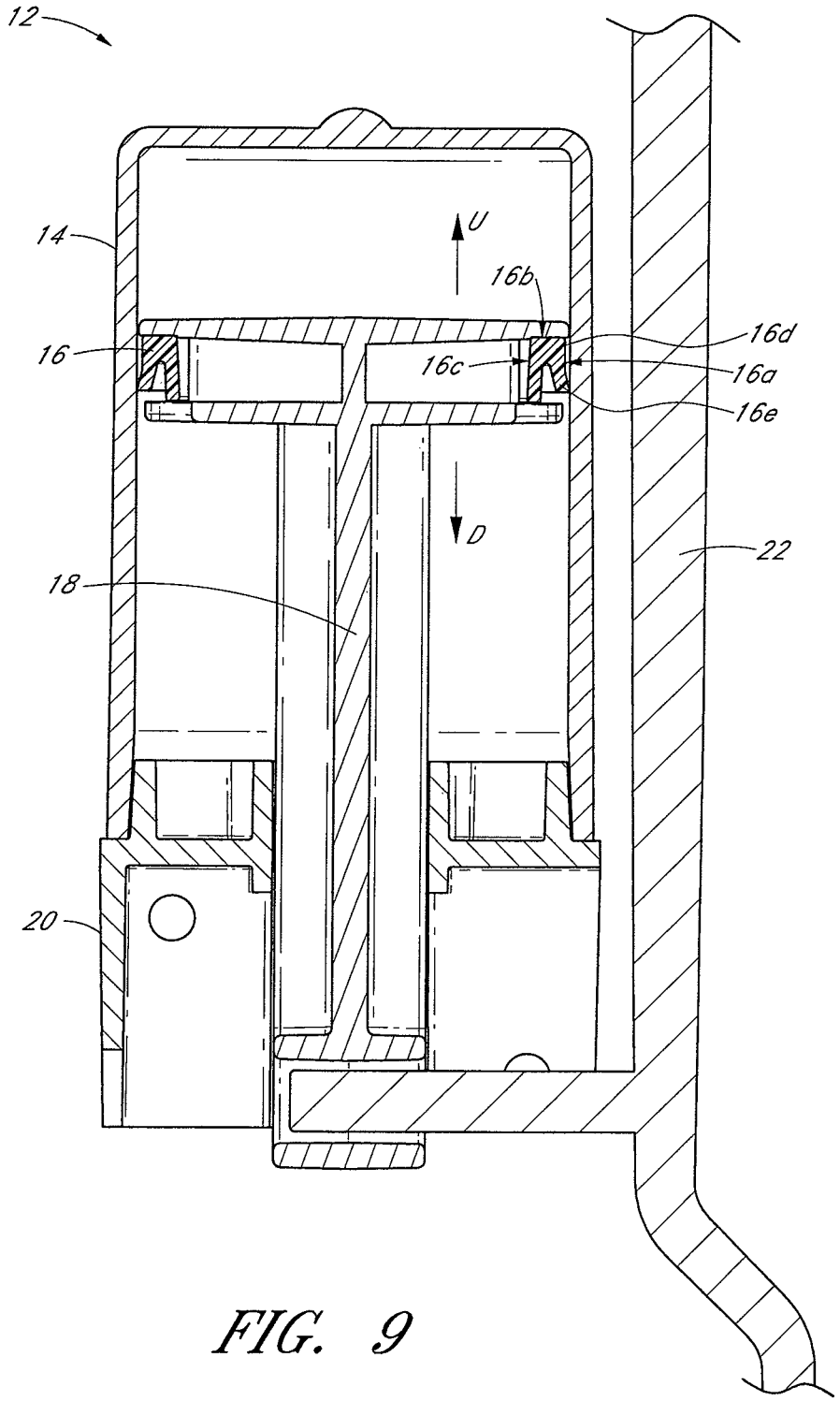
FIG. 9 is a sectional view of the dampening mechanism illustrated in FIG. 8 taken along line 9-9 when the lid is at or near its open position.
Figure 10:
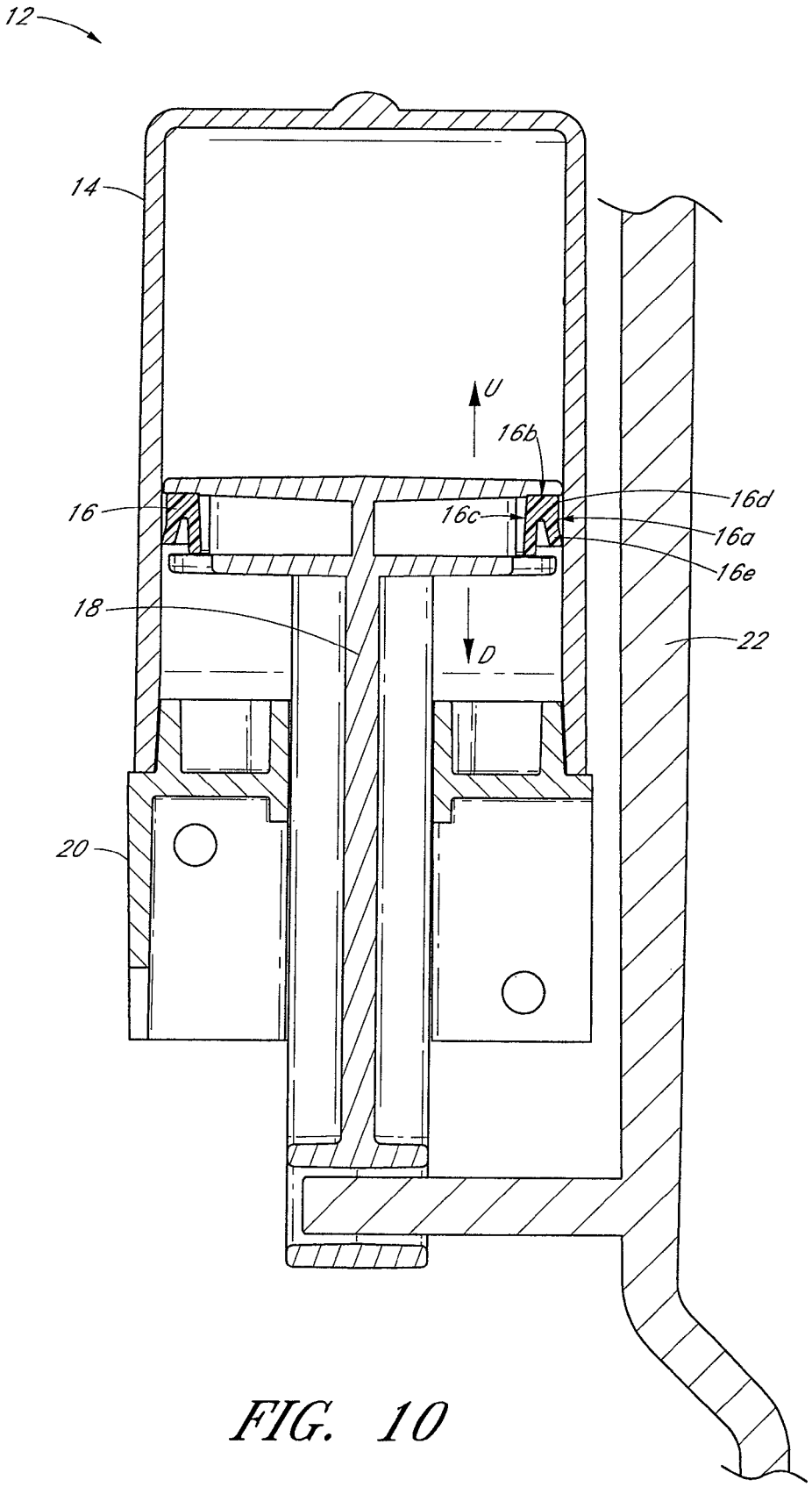
FIG. 10 is a sectional view of the dampening mechanism illustrated in FIG. 9 when the lid is at or near its closed position.

As shown in FIGS. 8-10, the motion damper 12 can be a fluid type damper operating with air as the working fluid. The motion damper 12 can be configured to interface and/or be in operable communication with the pedal, lid, and/or linkage (e.g., rod) connected any some point between them, such as by interfacing with a third portion 21 of the rod 22 near the upper end of the rod 22. As shown in FIG. 3, the motion damper 12 can include a receiving portion 14 for receiving a piston portion 18. The piston portion 18 can include a sealing member 16.

The motion damper 12 can be positioned closer to the lid portion 4 than the base portion 30. For example, the motion damper 12 can be positioned near the lid portion 4. In some embodiments, positioning the one or more motion dampers 12 near the lid or upper edge of the receptacle assembly 2 and/or at least partially or completely outside of the main body of the receptacle assembly 2 into which contents (e.g., trash, recyclables, clothing, food, etc.) are inserted, and not on the base or along a middle or central region of the sidewall, can help to provide a generally open bottom, side, and/or top region that can provide more space or volume for the insertion of contents into the interior of the receptacle assembly 2. In some embodiments, this arrangement permits the contents and/or the bottom of a content bag (if any) inserted into the interior to be positioned in a generally unobstructed, even manner generally along the bottom of the interior cavity of the receptacle assembly 2.

The motion damper can include a securing portion, such as a bracket portion 20. The bracket portion 20 can secure the motion damper 12 to the body portion 5. For example, the bracket portion can secure the motion damper 12 to the rear shell portion 10 and/or the upper body portion 6. One advantage of securing the motion damper 12 exterior to the upper body portion 6 is that there is no need for an inner body portion because the upper body portion 6 is substantially unobstructed.

The receiving portion 14 can define a cylinder in which a piston portion 18 can reciprocate. In some embodiments, the dampening function of the dampening mechanism 12 can be achieved by way of the resistance of the flow of a fluid, such as air, into and out of the receiving portion 14. This can generate sufficient damping forces for slowing the closing of the lid portion 4.

The piston 18 can include a piston head and a piston rod extending from the piston head and outwardly from a lower end of the receiving portion 14. The piston rod can include an aperture 17 configured to allow the piston rod to be movably engaged with the rod 22.

As shown in FIGS. 9-10, when the pedal portion 3 is pressed toward the open position, the piston 18 inside the damper receiving portion 14 is moved upward in direction U and/or further into the receiving portion 14. The third portion 21 of the rod 22 can push the piston portion 18 in the upward direction U.

When the force on the pedal portion 3 is released, the combined forces from the weight of the lid portion 4 (if applicable), the weight of other components connected to the lid portion 4 and/or other biasing devices configured to bias the lid portion 4 toward the closed position, push the rod 22 downward. As the rod 22 moves downward, the piston 18 is pulled downward in direction D and/or at least partially out of the receiving portion 14. However, the relative pressure between the atmosphere acting on the bottom of the piston 18 and the air trapped between the top of the piston 18 and the top of the receiving portion 14 opposes the immediate downward motion of the piston 18 as the piston begins to move downward, and thus opposes the downward motion of the lid portion 4 toward its closed position.

The piston 18 can be configured to provide less resistance to the upward movement of the piston 18 within the receiving portion 14 but provide greater resistance against the downward movement of the piston 18 within the receiving portion 14.

The piston 18 can be provided with a sealing member 16. The sealing member 16 can be generally annular in shape and can be configured to operate similarly to a check valve. In some embodiments, the sealing member 16 can have any configuration that can provide a similar function to a check valve.

The sealing member 16 can have an inner wall 16*c* and an outer wall 16*a* connected by a top wall 16*b*. The outer wall 16*a* can include an upper portion 16*d* that extends generally parallel to the inner wall 16*c* and a projecting portion 16*e* that is biased to extend radially outwardly relative to the upper portion 16*d*. The outer diameter or cross-sectional width of the upper portion 16*d* is slightly smaller than the diameter or cross-sectional width of the projecting portion 16*e*. The ramped configuration of the projecting portion 16*e* (when in a relaxed state) relative to the upper portion 16*d* can help to achieve the check valve type functionality of the sealing member 16.

For example, as the piston 18 moves upward in direction U within the receiving portion 14, air flows downward in direction D along the inner walls of the receiving portion 14, past the projecting portion 16*e* of the sealing member 16. Due to the ramped shape of the projecting portion 16*e*, the pressure generated within the upper portion of the receiving portion 14 above the piston 18 helps deflect the projecting portion 16*e* radially inwardly, thereby allowing the air to pass thereby without generating a larger resistance.

However, when the piston 18 moves downward within the receiving portion 14, the air pressure in the space above the piston 18 drops relative to the pressure of the atmosphere, thereby causing the projecting portion 16*e* to further expand against the inner walls of the receiving portion 14. This generates additional resistance to the flow of air into the space above the piston 18. As such, the sealing member 16 generates more resistance to the downward movement of the piston 18 than against the upward movement of the piston 18.

In some embodiments, the sealing member 16 can be lubricated with any suitable lubricant, such as an oil, molybdenum or graphite powder. Some examples of lubricants and some examples of dampers, any of which can be applied to embodiments of receptacle assemblies 2, are disclosed in U.S. Pat. Nos. 6,513,811 and 6,726,219, the entire contents of both of which, including the specific portions including the descriptions of damper design and lubrication, are hereby incorporated by reference. The size of the dampening mechanism 12 can be chosen by the designer to provide the desired functionality and performance.

For example, the height of the receiving portion 14, which can be related to the length of the maximum vertical movement of the piston 18 within the receiving portion 14, can be chosen to accommodate the maximum vertical displacement of the pedal portion 3. Additionally, the diameter of the receiving portion 14 and the type of sealing member 16 used affects the resistance generated during the downward movement of the piston 18. Thus, these dimensions can be chosen to provide the desired dampening characteristics.

Some advantages can be achieved when the size of the receiving portion 14 and the position at which the receiving portion 14 is mounted within the receptacle assembly 2 can be adjusted to provide desired characteristics of the motion of the lid portion 4 during its closing movement. For example, if the receiving portion 14 is mounted in a position where the piston 18 is spaced excessively far from the top of the receiving portion 14 when the piston 18 is at its maximum vertical position, the lid portion 4 can initially move too quickly from its fully open position toward its closed position. Such an initial quick movement can cause the lid portion 4 to bounce during its downward movement.

However, if the mounting position of the receiving portion 14 is adjusted so that the piston 18 is closely spaced relative to the top of the receiving portion 14 when the piston 18 is at its maximum upper position, the damper provides additional dampening, at least initially, thereby providing a slower, more aesthetically pleasing motion.

For example, by adjusting the position of the receiving portion 14 such that a spacing between the piston 18 and the top of the receiving portion 14 when the piston 18 is at its maximum position, when the foot pedal portion 3 is released, the lid portion 4 can begin to move very slowly initially, and slowly accelerate to an acceptably slow closing speed, such that the lid portion 4 does not make an excessive loud noise when it finally comes to rest. In some embodiments, the spacing can be equal to or less than about 10% of the total movement of the piston 18. The initial movement of the piston 18 is further slowed at the spacing is about 5% or less of the total movement of the piston 18. Finally, mounting the receiving portion 14 such that the spacing is about 4% or less of the total movement of the piston 18 provides further slowing, and thus achieves a more aesthetically pleasing movement.

At least one of the lid portion 4, receiving portion 14, piston 18, sealing member 16, and the pedal portion 3 can be configured to achieve the desired closing speed. For example, but without limitation, the above parameters can be chosen to achieve a closing speed of the lid of about 5 seconds from the moment a user removes their foot from the pedal portion 3.

Figure 11:
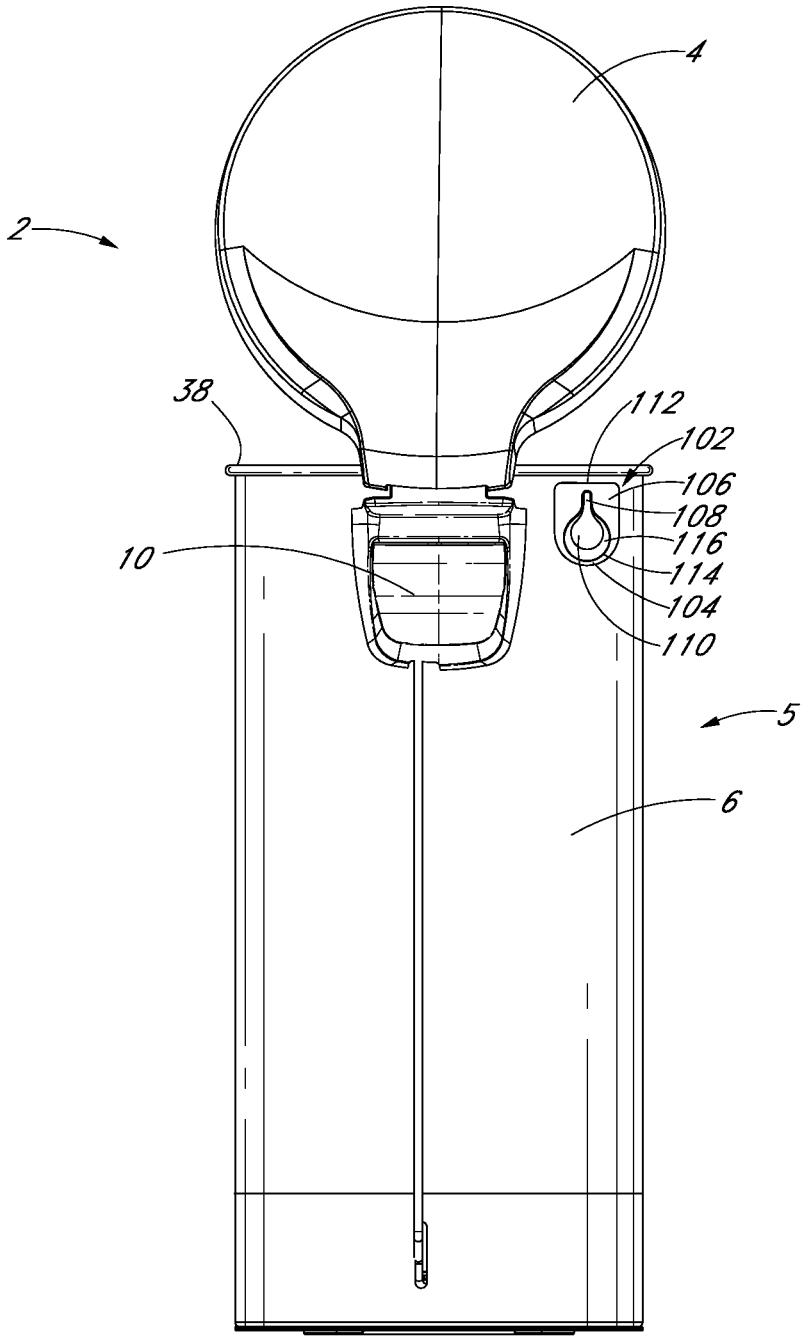
FIG. 11 is a rear view of the receptacle assembly having a bag-securing member.

FIGS. 11-14 illustrate a bag-securing member 102 configured to secure a bag within a receptacle assembly, such as the receptacle assembly 2 described herein. A bag can be positioning within the interior of the receptacle assembly 2. An open end or portion of the bag can comprise a periphery that is larger than the periphery of the upper opening of the receptacle assembly. To assist in providing a generally tight and generally secure connection between the bag and the receptacle assembly, the excess portion of the bag (e.g., a portion of the periphery of the bag that generally corresponds to the amount by which the length of the periphery of the bag exceeds the length of the periphery of the receptacle upper opening) can be secured to the receptacle assembly 2 using the bag securing member 102. As shown in FIG. 11, the upper body portion 6 can include an upper edge 38 protruding outward from the upper body portion 6. The upper edge 38 can be a rolled out portion of the upper body portion 6. In certain embodiments, the upper edge 38 can form a rounded lip. The bag can be wrapped around the upper edge 38 and the excess portion of the bag can be secured through an opening of the bag-securing member 102.

The bag-securing member 102 can be positioned near or along a portion of the upper body portion 6 of the receptacle assembly 2. The bag-securing member 102 can be positioned near an upper portion of the upper body portion 6 and/or along a front surface, a rear surface, or a side surface of the upper body portion 6. In certain embodiments, the bag-securing member 102 can be positioned along the same side of the receptacle as the connection between the lid 4 and the upper body portion 6. In certain embodiments, the bag-securing member 102 can be positioned near the rear shell portion 10. For example, as shown in FIG. 11, the bag-securing member can be positioned near a side edge of the rear shell portion 10.

In certain embodiments, the receptacle 2 can include a frame portion (not shown) connected to an upper portion of the upper body portion 6, and the bag-securing member 102 can be positioned along a wall of the frame portion. The frame portion can include one or more side wall portions and an opening configured to allow refuse to pass through the frame portion and into the interior cavity of the receptacle.

As shown in FIG. 11, the upper body portion 6 can include a support portion 104 projecting outward from the upper body portion 6, such that the bag-securing member 102 is disposed along a plane substantially parallel to a surface of the upper body portion 6. In some examples, the support portion 114 can project inward into the interior cavity 7 of the receptacle assembly 2.

Figure 12:
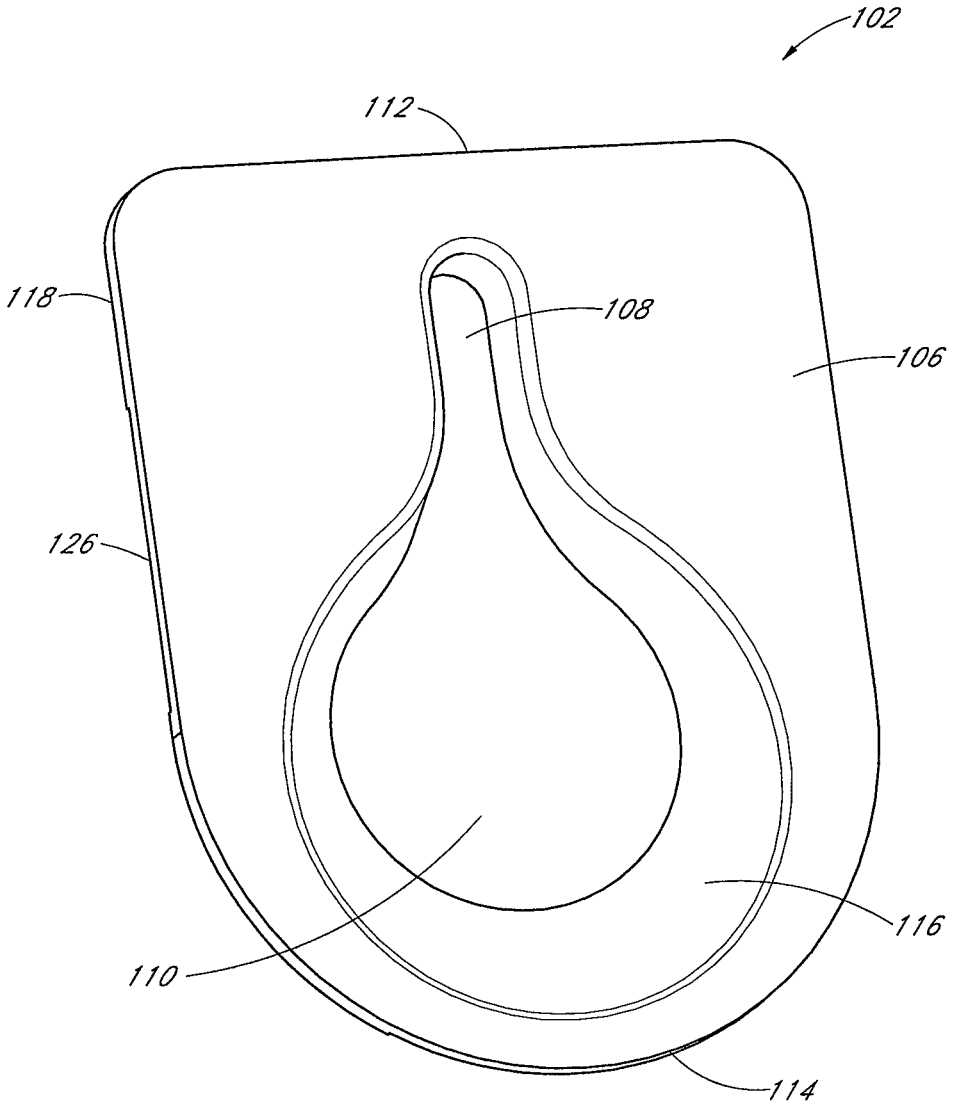
FIG. 12 is a perspective view of the bag-securing member illustrated in FIG. 11.
Figure 13:
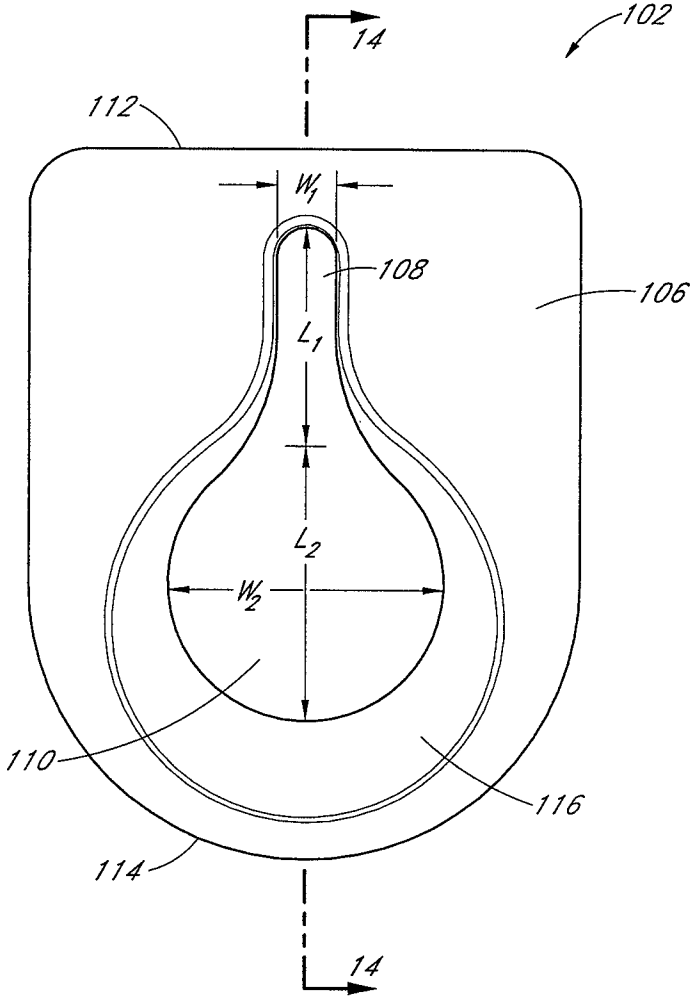
FIG. 13 is a front view of the bag-securing member illustrated in FIG. 11.

As shown in FIGS. 12 and 13, the bag-securing member can include a first edge 112 and a second edge 114. One or both of the first edge 112 and the second edge 114 can be substantially straight or substantially rounded. For example, the first edge 112 can be substantially straight, and the second edge 114 can be substantially rounded.

The bag-securing member 102 can include a front surface 106 and a rear surface 118. In certain embodiments, one or both of the front surface 106 and the rear surface 118 can be substantially flat or substantially curved. As shown in FIG. 12, both the front surface 106 and the rear surface 118 can be substantially flat. In certain embodiments, the rear surface 118 can include a recessed portion 126. The recessed portion 126 can be configured to mate with a corresponding projecting feature of the upper body portion 6.

The bag-securing member 102 can include an opening. The opening can include a first opening portion 108 and a second opening portion 110. In certain embodiments, the opening can be substantially tear-drop shaped. In certain embodiments, the opening can include substantially rounded edges. In certain embodiments, the first opening portion 108 can include a substantially elongate shape, and/or the second body portion 110 can include a substantially circular shape. In certain embodiments, the first opening portion 108 can be smaller than the second opening portion 110. In certain embodiments, the second opening portion 110 can include a width $W_2$ that is at least four times a width $W_1$ of the first opening portion 108, at least three times the width $W_1$ of the first opening portion 108, at least two times the width $W_1$ of the first opening portion 108, or otherwise. In certain embodiments, the second opening portion 110 can include a length $L_2$ that is at least three times a length $L_1$ of the first opening portion 108, at least two times the length $L_1$ of the second opening portion 108, at least 1.5 times the length $L_1$ of the first opening portion 108, substantially the same as the length $L_1$ of the first opening portion 108, or otherwise.

Figure 14:
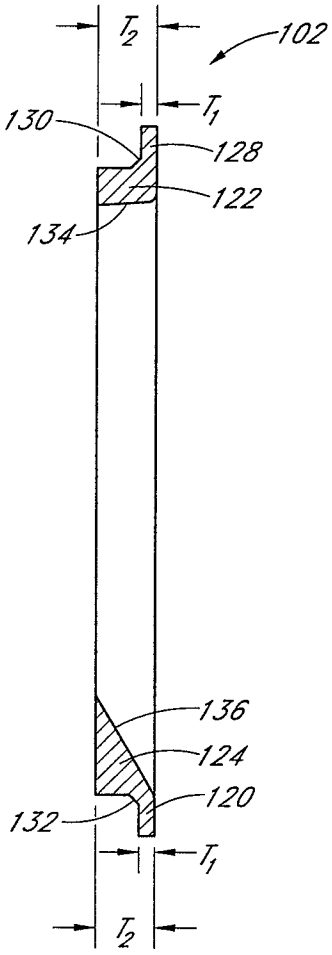
FIG. 14 is a sectional view of the bag-securing member illustrated in FIG. 13 taken along line 14-14.
Figure 16:
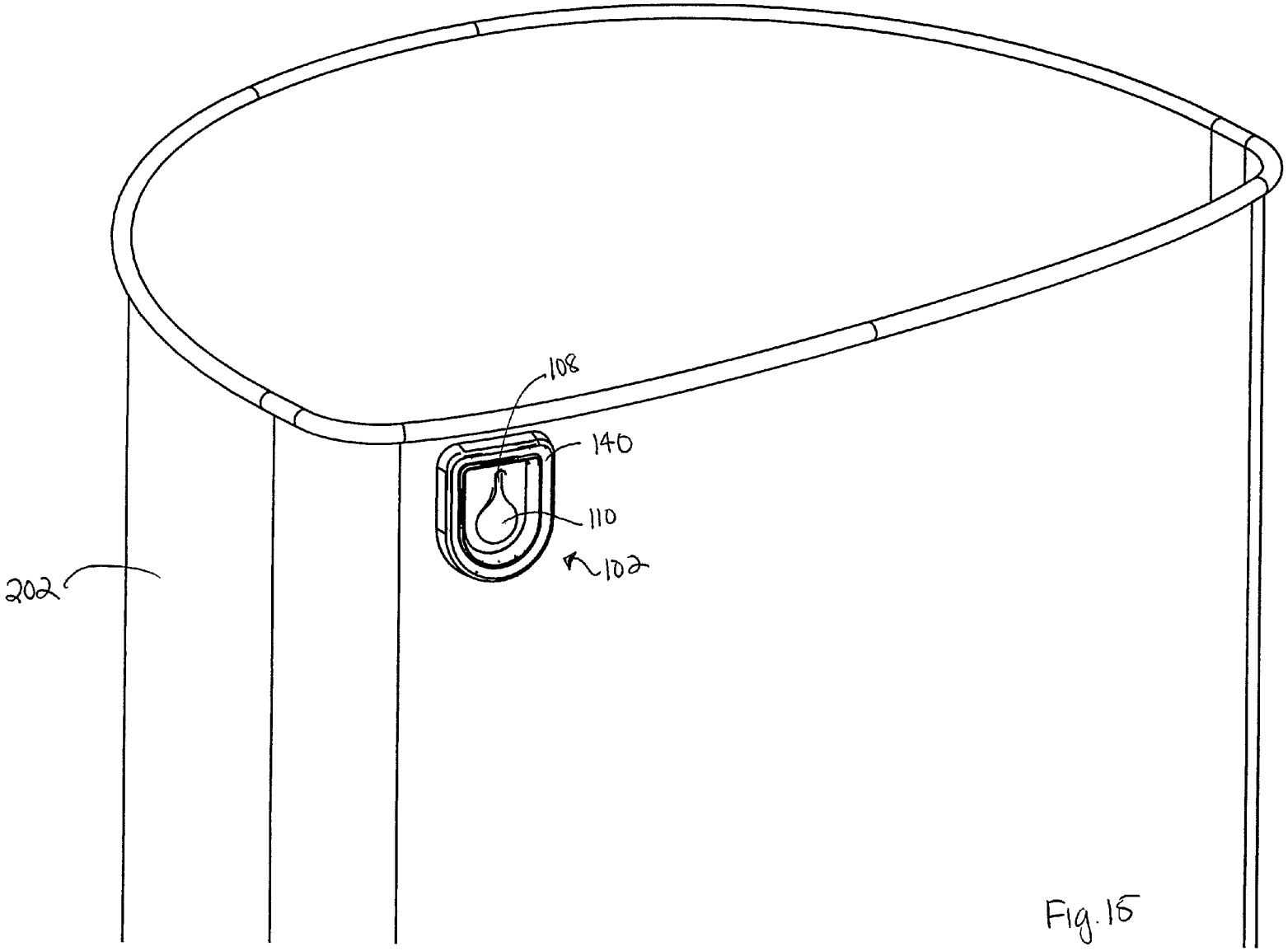
FIG. 16 is a view from an interior of the receptacle assembly illustrated in FIG. 15 having the bag-securing member.
Figure 16:
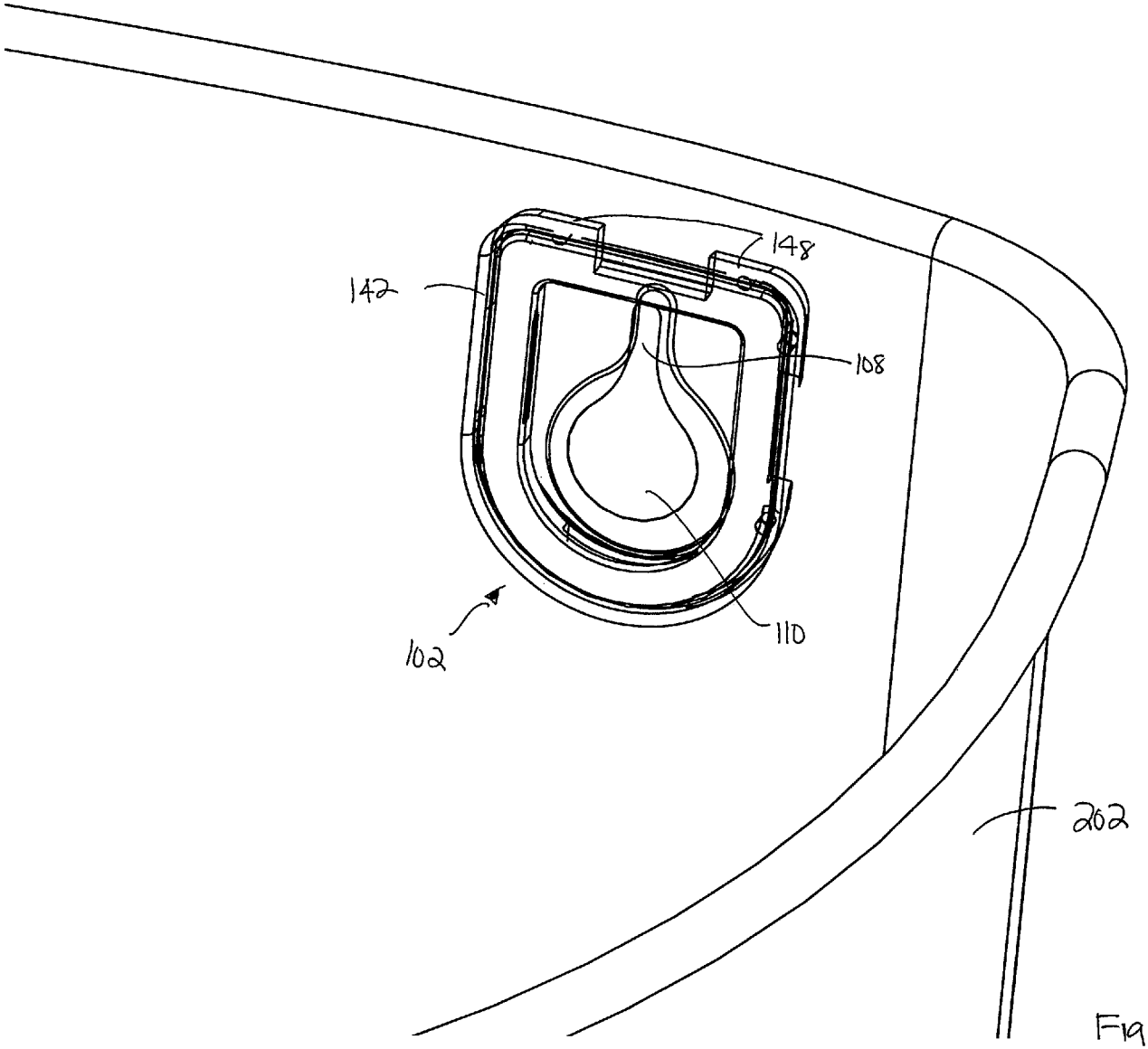

The bag-securing member 102 can include an inner wall portion 116 surrounding the opening. At least a portion of the inner wall portion 116 can be tapered. As shown in FIG. 14, an edge 136 of the inner wall portion 116 can be tapered. In certain embodiments, the thickness of the inner wall portion 116 can vary. For example, as shown in FIGS. 12-13, the thickness of the inner wall portion 116 can be greater along the first opening portion 108 than the second opening portion 110. In certain embodiments, the inner wall portion 116 can become increasingly thicker moving from a top of the opening to a bottom of the opening.

FIG. 14 illustrates a cross-section of the bag-securing member 102. In certain embodiments, the bag-securing member 102 can have a substantially uniform thickness. In certain embodiments, as shown in FIG. 14, the bag-securing member 102 can include areas of reduced thickness. For example, the bag-securing member 102 can include an upper projecting portion 128 and a lower projecting portion 120, each having a thickness $T_1$, and a first wall portion 122 and a second wall portion 124, each having a thickness $T_2$. The thickness $T_2$ can be greater than the thickness $T_1$.

In certain embodiments, the thickness of one or both of the first wall portion 122 and the second wall portion 124 can vary. In certain embodiments, the cross-section of the first wall portion 122 can be substantially rectangular and/or can include a substantially uniform thickness. In certain embodiments, the cross-section of the second wall portion 124 can be substantially triangular and/or include a varying thickness. For example, an upper portion of the second wall portion 124 can be less thick than a lower portion of the second wall portion 124.

In certain embodiments, as shown in FIG. 14, the upper edge 136 of the second wall portion 124 can be disposed at an angle relative to a bottom edge 134 of the first wall portion 122. The bottom edge 134 of the first wall portion 122 can be substantially parallel with a transverse axis of the bag-securing member 102, while the upper edge 136 of the second wall portion 124 can be disposed at an angle relative to the transverse axis of the bag-securing member 102.

The upper projecting portion 128 and the first wall portion 122 can form a chamfer edge, a fillet, a right angle edge, or otherwise, and the lower projection portion 120 and the second wall portion 124 can form a chamfer edge, a fillet, a right angle edge, or otherwise. For example, as shown in FIG. 14, the upper projecting portion 128 and the first wall portion 122 can form a chamfer edge 130, and the lower projecting portion 120 and the second wall portion 124 to form a chamfer edge 132. The bag-securing member 102 can be integrally formed with an upper body portion 6 of the receptacle assembly 2 or separately formed and connected to the upper body portion 6. If the components are separately formed, the bag-securing member 102 can be connected to the upper body portion 6 using an adhesive, a snap fit, welds, screws, or otherwise.

Figure 17:
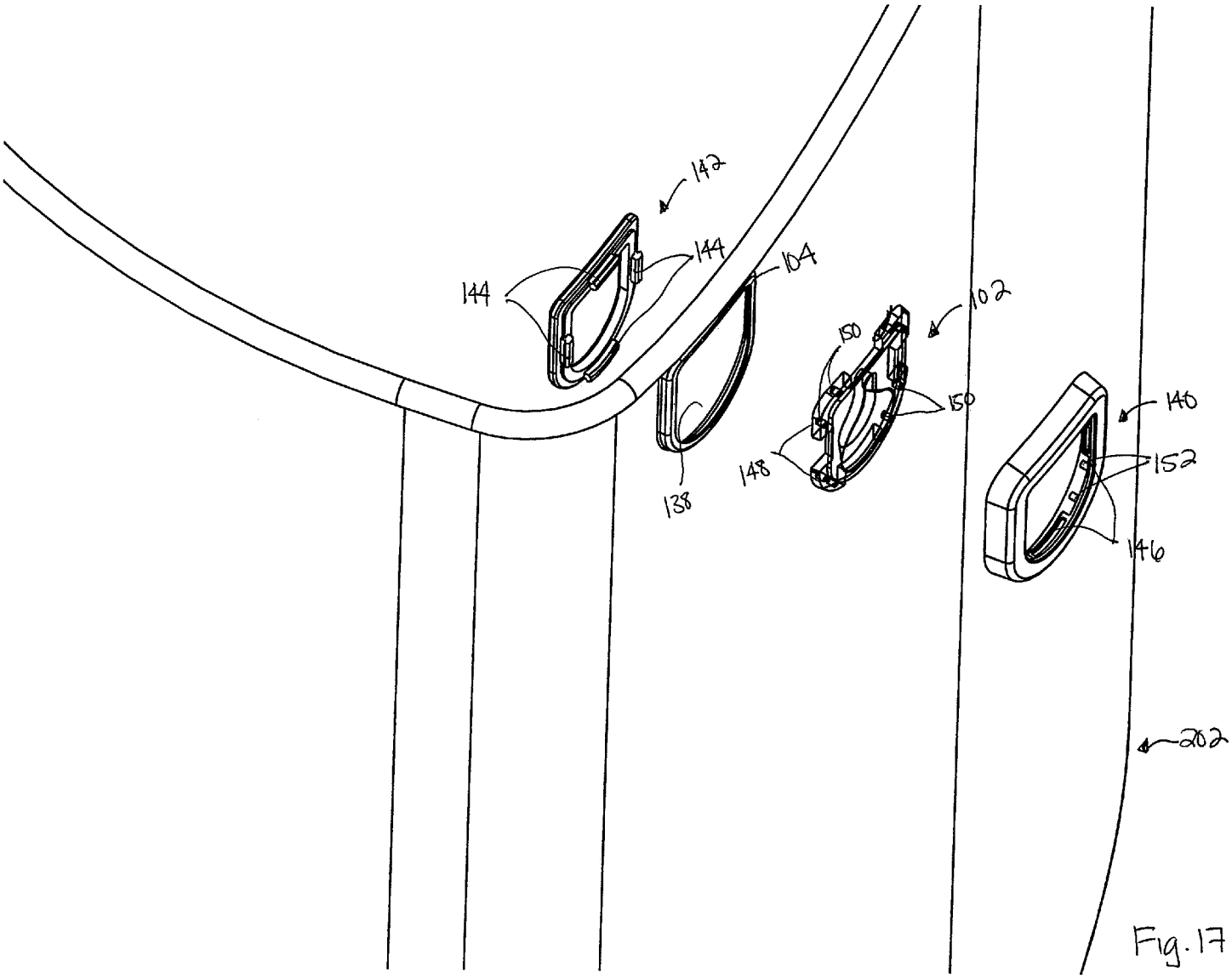
FIGS. 17-18 are exploded views of the bag-securing member illustrated in FIG. 15.
Figure 18:
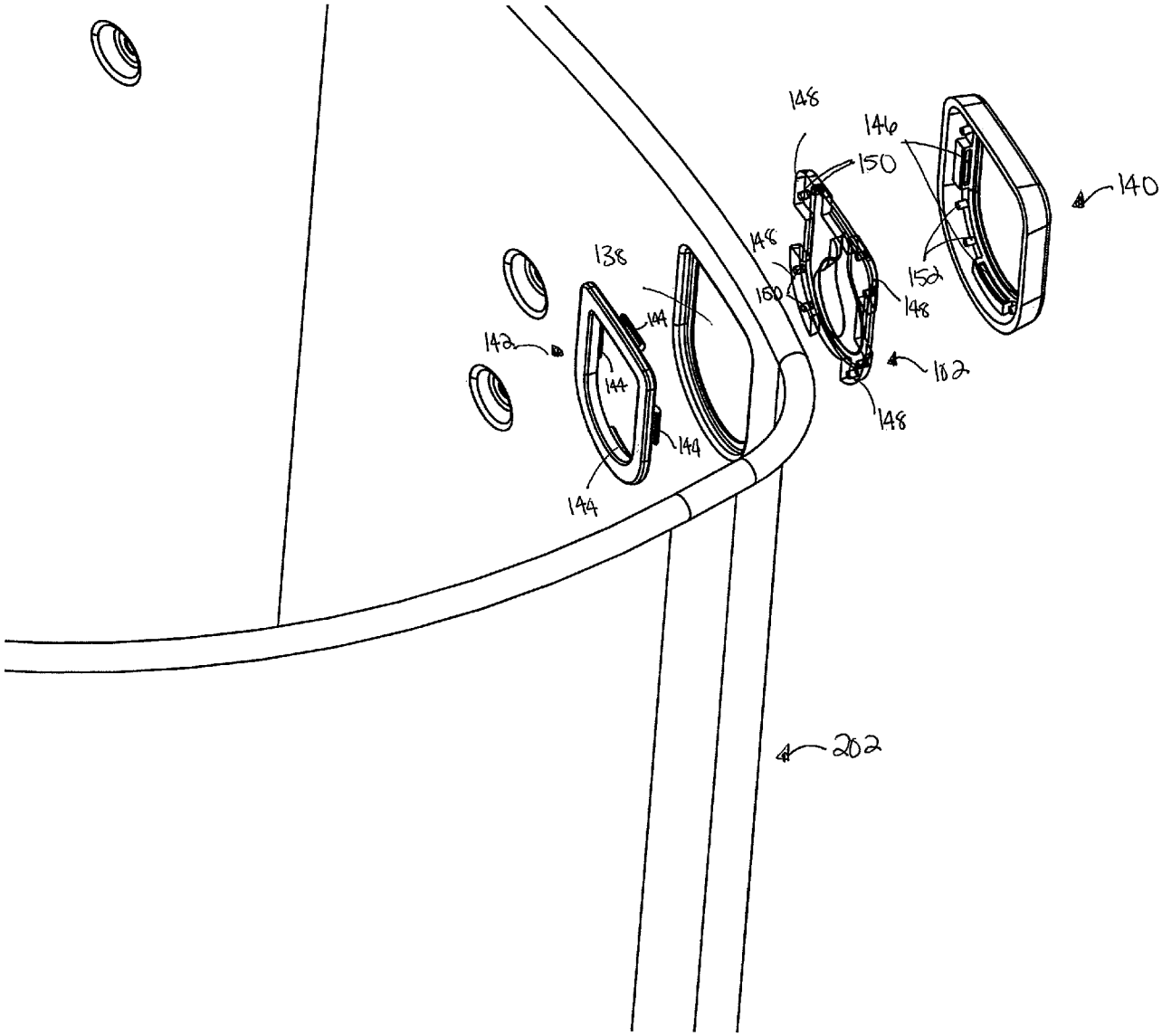

In certain embodiments, the bag securing member can include one or more attachment portions 148. As shown in FIGS. 17 and 18, the attachment portions 148 can be positioned at each corner of the bag securing member 102. The attachment portions 148 can be secured to an interior or exterior wall of the upper body portion 6 using screws, an adhesive, or otherwise.

As shown in FIGS. 15-18, the bag securing member 102 can be secured to a receptacle assembly 202, which can include any of the features described in connection with the receptacle assembly 2. The bag securing member 102 can be secured to the receptacle assembly 202 using one or more frame portions 140, 142. For example, the bag securing member 102 can include an outer frame portion 140 and an inner frame portion 142. The outer frame portion 140 can include a surface disposed outside of the receptacle assembly 2, while the inner frame portion 142 can include a surface disposed within the interior of the receptacle assembly 202. The frame portions 140, 142 can each have an outer edge that generally corresponds to the shape of the bag securing member and an opening to provide access to the bag securing member 102.

The outer frame portion 140 can be configured to engage the inner frame portion 142. For example, the outer and inner frame portions 140, 142 can be snapped together, glued together, screwed together, or otherwise. In certain embodiments, the outer frame portion 140 can include one or more connecting features 146 (e.g., grooves, openings, slots, protrusions, ribs, or otherwise) configured to mate with one or more corresponding features 144 (e.g., grooves, openings, slots, protrusions, ribs, or otherwise) on the inner frame portion 142. As shown in FIGS. 17 and 18, the outer frame portion 140 can include grooves 146 configured to snap together with the inner frame portion protrusions 144.

The frame portions 140, 142 can connect to the receptacle assembly 202 using a connector, such as adhesive, screws, snap-fit mechanism, or otherwise. As shown in FIGS. 17 and 18, the receptacle assembly 202 can include an opening 138 surrounded by a support portion 104. The outer frame portion 140 can be configured to attach (e.g., snap) over the outwardly extending support portion 104.

The bag securing member 102, the outer frame portion 140, and the inner frame portion 142 can each include a metal and/or a polymer material. For example, the bag securing member 102 can include a resilient, flexible, or rubbery material and/or the outer and inner frame portions 140, 142 can each include a plastic material.

In some embodiments, each of the bag securing member 102, the outer frame portion 140, and the inner frame portion 142 can be separately formed. The bag securing member 102 can be secured to the outer frame portion 140 using a connector, such as adhesive, screws, a snap-fit mechanism, or otherwise. In certain embodiments, the bag securing member 102 can include one or more first connection portions, such as openings 150, for example, on the attachment portions 148, for facilitating connection with (e.g., by receiving) one or more second connection portions, such as one or more pegs 152 of the outer frame portion 140. In certain variants, the bag securing member 102 and the outer frame portion 140 can be co-molded and configured to snap together with the inner frame portion 142.

Although the receptacle assembly has been disclosed in the context of certain embodiments and examples, it will be understood by those skilled in the art that the receptacle assembly extends beyond the specifically disclosed embodiments to other alternative embodiments and/or uses of the embodiments and certain modifications and equivalents thereof. It should be understood that various features and aspects of the disclosed embodiments can be combined with or substituted for one another in order to modify the receptacle assembly. Accordingly, it is intended that the scope of the receptacle assemblies herein-disclosed should not be limited by the particular disclosed embodiments described above, but should be determined only by a fair reading of the claims that follow.

The following is claimed:

1. A receptacle assembly comprising:

a body portion comprising an upper portion and a base portion, the body portion defining an interior space;

a lid portion movably engaged with the body portion, the lid portion configured to move between a fully open position and a closed position;

a pedal portion configured to move the lid portion between the fully open position and the closed position;

a rod extending between the lid portion and the pedal portion; and a motion damper positioned near the lid portion and configured to interface with the rod when the lid portion is in the fully open position and the closed position, wherein the motion damper dampens motion of the lid portion, wherein when the pedal is pressed downward, the rod moves at least two components of the motion damper to a first configuration, wherein when the pedal is released, the rod moves the at least two components of the motion damper to a second configuration, and wherein at least a portion of the rod extends along a region exterior to the body portion below the motion damper.

2. The receptacle assembly of claim 1, wherein the base portion is removably coupled to the upper portion.

3. The receptacle assembly of claim 1, wherein the body portion further comprises a lower shell portion positioned within the body portion, a height of the lower shell portion being substantially less than a height of the upper body portion.

4. The receptacle assembly of claim 1, wherein the body portion further comprises a rear shell portion positioned near the lid portion.

5. The receptacle assembly of claim 4, wherein the motion damper is connected to the rear shell portion.

6. The receptacle assembly of claim 1, wherein the motion damper is positioned exterior to the upper portion of the body portion.

7. The receptacle assembly of claim 1, wherein the receptacle assembly further comprises an inner body portion, the inner body portion defining an interior space having substantially the same volume as the interior space of the body portion.

8. The receptacle assembly of claim 1, wherein the motion damper comprises a receiving portion and a piston portion, the receiving portion defining an interior space for receiving the piston portion.

9. The receptacle assembly of claim 8, wherein the motion damper further comprises a sealing member.

10. The receptacle assembly of claim 8, wherein the piston portion is configured to move from a lower position to an upper position as the lid portion moves from the closed position to the open position.

11. The receptacle assembly of claim 8, wherein the piston portion is configured to move further into the receiving portion as the lid portion moves from the closed position to the open position.

12. A method of manufacturing a receptacle assembly comprising:

forming a body portion comprising an upper portion and a base portion, the body portion defining an interior space;

movably engaging a lid portion with the body portion, the lid portion configured to move between a fully open position and a closed position;

movably engaging a pedal portion with the body portion, the pedal portion configured to move the lid portion between the fully open position and the closed position;

extending a rod from the lid portion to the pedal portion; and movably engaging a motion damper with the rod such that the rod interfaces with the motion damper when the lid portion is in the fully open position and the closed position, and at least a portion of the rod extends along a region exterior to the body portion below the motion damper, wherein the rod interfaces with the motion damper such that, when the pedal is pressed downward, the rod moves at least two components of the motion damper to a first configuration, and when the pedal is released, the rod moves the at least two components of the motion damper to a second configuration, wherein the motion damper is configured to dampen motion of the rod, and wherein the motion damper is positioned near the lid portion.

13. The method of claim 12, wherein forming the body portion comprises removably coupling the base portion to the upper portion.

14. The method of claim 12, further comprising positioning a lower shell portion in the interior space of the body portion, a height of the lower shell portion being substantially less than a height of the upper body portion.

15. The method of claim 12, wherein forming the body portion further comprises connecting a rear shell portion near the lid portion.

16. The method of claim 15, further comprising connecting the motion damper to the rear shell portion.

17. The method of claim 12, wherein movably engaging the motion damper with the rod comprises positioning the motion damper exterior to the upper portion of the body portion.

18. The method of claim 12, further comprising inserting an inner body portion into the body portion, the inner body portion defining an interior space having substantially the same volume as the interior space of the body portion.

19. The method of claim 12, further comprising forming a motion damper comprising a receiving portion and a piston portion, the receiving portion defining an interior space for receiving the piston portion.

20. The method of claim 19, wherein the motion damper further comprises a sealing member.

21. The method of claim 19, wherein the piston portion is configured to move from a lower position to an upper position as the lid portion moves from the closed position to the open position.

22. The method of claim 19, wherein the piston portion is configured to move further into the receiving portion as the lid portion moves from the closed position to the open position.

23. The receptacle assembly of claim 3, wherein the lower shell portion has a generally smooth surface for receiving contents of the receptacle assembly.

24. The receptacle assembly of claim 3, wherein the lower shell portion provides an upwardly facing bottom interior surface of the receptacle assembly.

25. The method of claim 14, wherein the lower shell portion has a generally smooth surface for receiving contents of the receptacle assembly.

26. The method of claim 14, wherein the lower shell portion provides an upwardly facing bottom interior surface of the receptacle assembly.

27. The receptacle assembly of claim 1, wherein the motion damper is configured to dampen motion of the lid portion by compressing air in the motion damper.

* * * * *